US008490341B2

(12) United States Patent
Hatzinikolas

(10) Patent No.: US 8,490,341 B2
(45) Date of Patent: Jul. 23, 2013

(54) SELF-RELEASING STRUCTURAL ASSEMBLY

(76) Inventor: Michael Hatzinikolas, Edmonton (CA)

( * ) Notice: Subject to any disclaimer, the term of this patent is extended or adjusted under 35 U.S.C. 154(b) by 0 days.

(21) Appl. No.: 13/408,410

(22) Filed: Feb. 29, 2012

(65) Prior Publication Data

US 2012/0192504 A1 Aug. 2, 2012

Related U.S. Application Data

(63) Continuation-in-part of application No. 13/098,908, filed on May 2, 2011, and a continuation-in-part of application No. 13/227,915, filed on Sep. 8, 2011.

(60) Provisional application No. 61/381,205, filed on Sep. 9, 2010.

(51) Int. Cl.
*E04C 1/00* (2006.01)

(52) U.S. Cl.
USPC ..... 52/99; 52/289; 52/98; 52/702; 52/272; 52/279; 52/232

(58) Field of Classification Search
USPC ..... 52/1, 98, 99, 100, 289, 702, 713, 52/272, 279, 283, 254, 167.1, 232
See application file for complete search history.

(56) References Cited

U.S. PATENT DOCUMENTS 3,119,475 A 1/1964 Adams
3,294,428 A 12/1966 Lickliter et al.
3,708,932 A 1/1973 Bailey et al.
5,163,256 A * 11/1992 Fukumoto et al. ..... 52/167.1
5,720,571 A * 2/1998 Frobosilo et al. ..... 403/403
7,520,095 B2 4/2009 Platt et al.
7,703,244 B2 * 4/2010 Suzuki et al. ..... 52/167.3
2003/0159376 A1 * 8/2003 Huynh ..... 52/208

FOREIGN PATENT DOCUMENTS

JP 03279556 A * 12/1991
JP 04343951 A * 11/1992

* cited by examiner

*Primary Examiner* — Joshua J Michener
*Assistant Examiner* — Matthew Gitlin
(74) *Attorney, Agent, or Firm* — Ostrolenk Faber LLP

(57) ABSTRACT

The end of a beam is joined to a wall structure by a self-releasing structural assembly. The self-releasing structural assembly has a first portion that is anchored to the wall. A second portion sticks out from the wall. This portion is fire-proof and non-thermally degradable. It defines a seat for receiving the beam end. The assembly also includes a thermally degradable member mounted to the second portion. In normal use the beam fasteners squeeze the end of the beam, the support bracket seat, and the consumable, thermally degradable member in compression. When exposed to heat or flame the consumable, thermally degradable member softens, releasing the compression in the structural sandwich of parts. The end of the beam is then able to translate away from the wall structure. The consumable member can be inspected, replaced if necessary, and the beam fasteners re-tensioned, without removing the beam end from the seat.

19 Claims, 15 Drawing Sheets

SELF-RELEASING STRUCTURAL ASSEMBLY

CROSS-REFERENCE TO RELATED APPLICATIONS

Figure 1A:
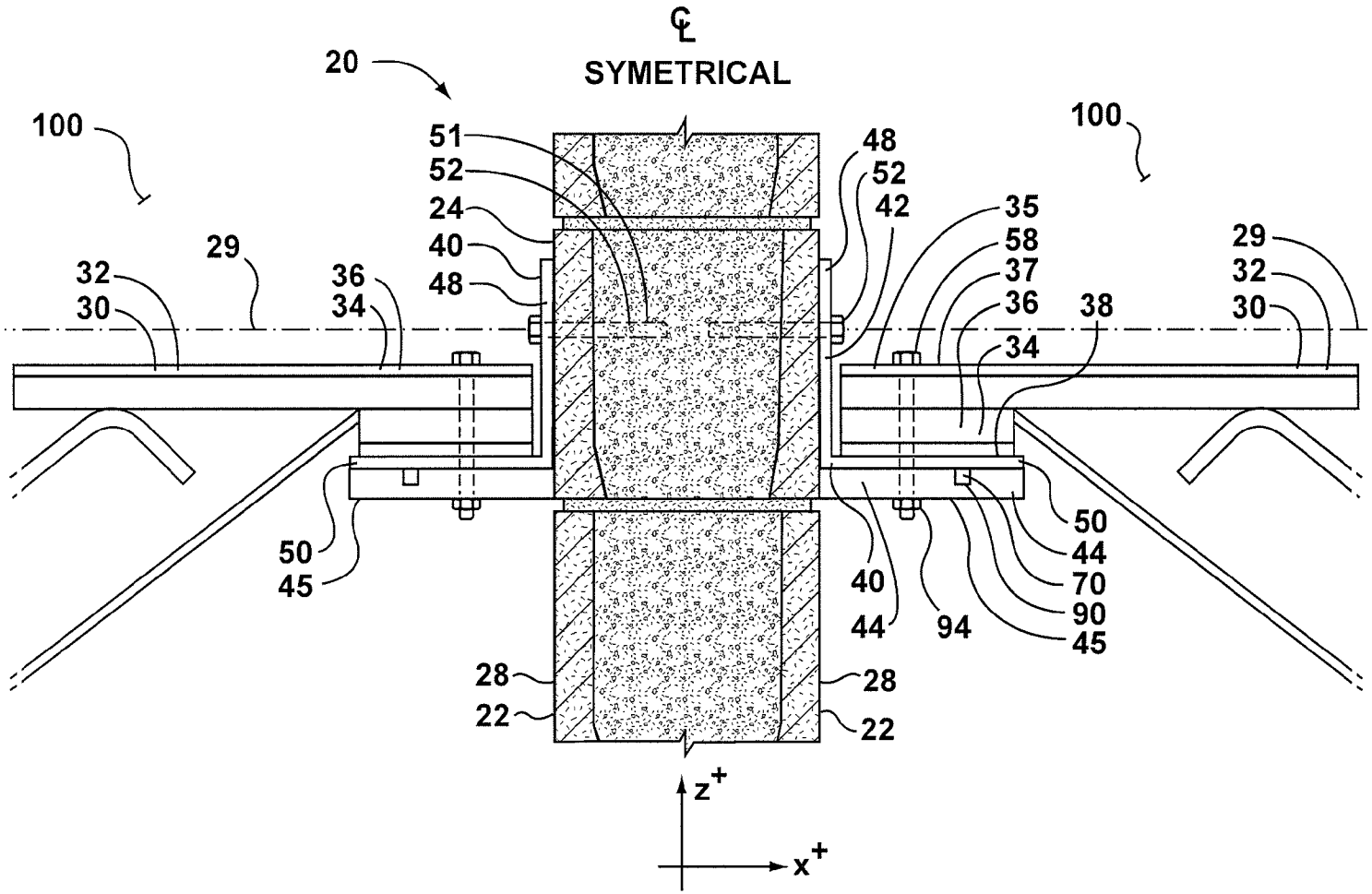

This application is a continuation-in-part of U.S. patent application Ser. No. 13/098,908, filed May 2, 2011, the content of which is incorporated herein by reference. This application is also a continuation-in-part of U.S. patent application Ser. No. 13/227,915, filed Sep. 8, 2011, which claims priority to U.S. Provisional Patent Application No. 61/381,205, filed Sep. 9, 2010, the contents of which are incorporated herein by reference.

FIELD OF INVENTION

This Application relates to structural materials for use in the construction of buildings, and, in one particular context, to support structure for joists or other structural cross-members, and to use thereof.

BACKGROUND OF THE INVENTION

This specification relates to a break-away connector for connecting structural components, such as a floor or ceiling to a firewall, and to a method of constructing a firewall connection system.

In residential, commercial and industrial building structures, it is often desirable to prevent fires from spreading. To that end these building structures may have separate dwelling or working spaces defined by structural members that are designed to slow or prevent the spread of fire between two (or more) adjacent spaces. These structural members may be firewalls. Firewalls are typically designed or treated to resist combustion and prevent rapid heat transfer. Most commonly, firewalls are substantially vertical partitions that define interior spaces such as individual rooms within the same structure, or interior spaces of separate, adjacent structures.

In some multi-level buildings, the firewall itself may support structural cross-members, such as floor joists, of higher floors of the structure. Commonly, substantially horizontal structural components such as floors or ceilings are tied into at least one substantially vertical firewall. There may be several firewalls, each supporting ends of many cross-members. In the event that those floor joists should move, it may be desirable for their dislodgement not to also cause the collapse of the firewall. That is, in the event that a heat-inducing event occurs within an interior space that is at least partially defined by a firewall, it is desirable for certain structural members to be releasable from the firewall. If a structural member catches fire, it may be beneficial for the structural member to be releasable from the firewall to separate the heat source from the firewall. This release can allow the firewall to remain intact for a longer duration. As a result, firefighters may be provided with sufficient time to prevent the spread of fire to adjacent spaces. In some cases, occupants in an adjacent room or structure may be provided with sufficient time to escape before the firewall is compromised and the fire spreads to the adjacent space.

To that end, the inventor proposes herein to provide an end support for these beams or joists in the normal course, but which end support may then permit the ends of the joists to release from the firewall in the event of a fire, with the hope that the firewall may then not be damaged and may be able to continue to perform its protective function as a firewall.

Structural connectors comprising a fusible member are generally known in the art. See for example U.S. Pat. Nos. 3,119,475; 3,294,428; 3,708,932 and 7,520,095. As described in these patents, when at least one fusible member is weakened by heat, at least one structural member is permitted to move relative to another. These patents disclose the use of fusible members to accommodate the thermal expansion of at least one heated structural member, to reduce such undesirable consequences as thermal buckling.

U.S. Pat. No. 3,708,932 discloses the use of a fusible break away clip to releasably couple structural members. This patent discloses fusible break away clips that are made of a material that will burn or melt when subjected to fire. As disclosed, the clips are used to couple a structural member to a fire barrier member. When there is a fire on one side of the fire barrier member, the break-away clips may melt and disengage the structural member from the remainder of the wall structure.

SUMMARY OF INVENTION

The following summary may introduce the reader to the more detailed discussion to follow. The summary is not intended to, and does not, limit or define the claims.

According to one broad aspect, a break-away connector system includes a support member and a fusible member. The support member is connectable to a firewall for securing a floor or ceiling to the firewall. The support member is connectable to the floor or ceiling by at least one securing member. Any suitable means may be used to secure the support member to the floor or ceiling. The fusible member has a lower melting point than the support member. When the fusible member is weakened by heat, the floor or ceiling is slidably releasable from the support member.

The support member may have a horizontally extending support surface that is connected to the floor or ceiling. Accordingly, when the fusible member is at room temperature, the break-away connector system provides the required support. However, when the fusible member weakens due to heat, then the floor or ceiling may slide relative to the support member and thereby become separated from the firewall.

In operation, in an aspect of the invention, when the floor or ceiling catches fire, the fusible member is weakened and the floor or ceiling is slidably releasable from the support member. This release may distance a floor or ceiling that is on fire from the firewall by a sufficient amount to allow the firewall to remain intact for a longer duration of time. In some instances, the floor or ceiling may completely disengage from the support member thereby allowing the floor or ceiling to fall.

In normal operation the support member provides support for a structural member. Accordingly, the loading bearing capacity of the break-away connector system may not be a function of the load bearing capabilities of the fusible member itself.

Optionally, the fusible member may also have a channel through which the securing member extends. In operation, the fusible member may not necessarily have to burn all the way though to permit release of the structural member, be it a floor or ceiling member, from the firewall. Release may occur shortly after the break-away connector system is subjected to heat. This may allow the structural components to separate from one another sooner, thereby increasing the duration of time for which a firewall remains intact.

The support member may have a disengagement end and at least one channel that has an open end at the disengagement end. The fusible member may have at least one opening therethrough that is alignable with the channel of the support member. In a further feature, at least one securing member is extendable through both the support member and the fusible member to secure the support member to the floor or ceiling. In some cases, the opening of the fusible member may be an open ended channel that is alignable with the at least one channel of the support member.

In another feature, the fusible member may be lockingly securable to the support member. In some embodiments, the support member and the fusible member may have mating engagement members. The engagement member of the support member may include a protrusion or protuberance and the engagement member of the fusible member may include a mating depression or cavity or accommodations, such as a groove. In some cases, the fusible member has an opening that is an open-ended channel, and the groove extends at an angle to the opening of the fusible member.

In another feature, the support member may be configured for slidable release of the floor or ceiling from the support member with the at least one securing member attached to the floor or ceiling when the fusible member is weakened by heat. In a further feature, the support member may be fixedly secured to the firewall when the floor or ceiling is slidably disengagable from the support member. In another feature, the support member may be made of metal or plastic. The fusible member may be made of plastic. In another further feature, the support member may be an angle having a first section fixedly securable to a face of the firewall and having a second section substantially orthogonal to the first section. The second section may have at least one channel.

According to another aspect, there is a method for constructing a firewall connection system. The method includes (a) providing a support member and a fusible member whereby at least one securing member is slidably removable from the support member when the fusible member is weakened by heat; (b) securing a first section of a support member to a first structural member; and, (c) securing a second section of the support member to a second structural member by passing the at least one securing member through the second section of the support member and the fusible member and into the second structural member.

In a further feature of that aspect, the support member may have at least one open ended channel. Securing the second section of the support member to a second structural member may include passing the at least one securing member through the at least one open ended channel. In another feature, the fusible member may have at least one opening and the method may include passing the at least one securing member through the at least one opening. The fusible member may be positioned in an abutting relationship with the support member. In another feature, the fusible member may be interengaged.

In another aspect of the invention, there is a self-releasing structural support assembly. It has a first member and a second member. The first member is made of a fireproof material. The first member has a first portion and a second portion. The first portion of the first member defines an anchor member by which the first member can be permanently secured to a structural reference datum member, and through which, when installed, a shear load can be passed into the structural reference datum member (i.e., in other words, it provides a load path for, typically, vertical shear loads to be transmitted between a load such as the end of a joist, and a reaction, such as the structural datum reference member). The second portion of the first member defines a reaction seat upon which to carry a foot of a spanning member and through which to receive a shear load from the spanning member. The second portion of the first member has a spanning member securement accommodation. The second portion of the first member has a first indexing member. The second member is one of (a) fire degradable; and (b) temperature degradable. The second member has a spanning member securement retention fitting that is co-operable with the spanning member securement accommodation. The second member has a second indexing member. On installation, the second indexing member of the second member is positioned in mating co-operation with the first indexing member of the first member. In operation, when so mated, the second member is secured in a position preventing disengagement of the spanning member; and, also in operation, when the second member is degraded by either one of (a) fire and (b) heat, the spanning member is disengageable (i.e., no longer prevented from disengagement) from the first member.

In another aspect of the invention, there is a self-releasing beam end support assembly. It includes a support fitting and a consumable member. The support fitting defines a seat upon which to support a beam end, and an anchor by which to attach the support fitting to a wall structure. The consumable member and the support fitting have co-operating beam fastener accommodations. The consumable member and the support fitting have mutually co-operating engagement fittings constraining location of the consumable member relative to the support fitting. The consumable member is one of (a) thermally degradable; and (b) fire degradable. In operation, under a first, non-degraded condition of the consumable member, the support fitting and the consumable member are co-operable with the beam fastener to discourage dislodgement of the beam end from the seat. Also in operation, under a second, degraded condition of the consumable member, the support fitting and the consumable member are co-operable to permit release of the beam end from the seat.

In an additional feature of either of those aspects of the invention, when installed, the seat is upwardly facing and the consumable member is located below the seat. In another feature, as installed, the condition of the consumable member is ascertainable, and the consumable member is replaceable while the beam end remains supported by the seat. In still another feature, the support fitting is mountable to a substantially planar wall, and, when mounted to such substantially planar wall, the beam fastener accommodations of the support fitting have a degree of freedom of linear translation substantially normal to the wall, and the seat has a range of accommodation position for the beam end along the degree of freedom. In a further feature, the range of accommodation is at least 2 inches long.

In another additional feature, the support fitting is one of (a) an angled member having a first leg for mounting to a wall, and a second, cantilevered leg that stands outwardly of the wall when the first leg is mounted thereto; and (b) a channel member having two legs and a back extending therebetween, such that when the channel member is embedded in a wall the back thereof is substantially horizontal and defines the seat. In still another feature, the support assembly is combined with embedment anchor hardware, the anchor member having fittings defined therein co-operable with the hardware. In still another feature, there are beam engagement fittings. The beam engagement fittings are threaded fasteners. The accommodations define slots. In use, the support fitting, the consumable member and a beam end are stacked together in a sandwich, and the threaded fasteners secure the sandwich, the sandwich being in compression and the threaded fasteners being in tension. In a further feature, the combination includes the beam.

In another aspect, there is a self-releasing structural support assembly. It has a first member and a second member. The first member is made of a fireproof material. The first member has a first portion and a second portion. The first portion of the first member defines an anchor member by which the first member can be permanently secured to a structural reference datum member, and through which, when installed, a shear load can be passed into the structural reference datum member. The second portion of the first member defines a reaction seat upon which to carry a foot of a spanning member and through which to receive a shear load from the spanning member. The second portion of the first member has a spanning member securement accommodation. The second portion of the first member has a first zone of asperities. The second member is one of (a) fire degradable and (b) temperature degradable. The second member has a spanning member securement retention fitting that is co-operable with the spanning member securement accommodation. The second member having a second zone of asperities. On installation, the second zone of asperities of the second member is in mating cooperation with the first zone of asperities of the first member. In operation, when so mated, the second member is secured in a position preventing disengagement of the spanning member. In operation, when the second member is degraded by either one of (a) fire and (b) heat, the spanning member is insecure from disengagement from the first member.

In a feature of that aspect of the invention, there is more than one second member. In another feature, the first member has a footprint, and at least one second member has a footprint that is not co-extensive with the footprint of the first member. In a further feature, there is a degree of freedom defining a direction of permissible disengagement of the spanning member from the first member when, in operation, the spanning member is insecure, and at least one of the first and second zones of asperities includes ridge members extending cross-wise relative to the direction of that degree of freedom. In a further additional feature, at least one of the first and second zones of asperities includes a plurality of serrations. In a still further feature, there is a plurality of the second members made of heat degradable material, each of the second members has a serrated face for engagement with a matching serrated face of the first member, each of the second members is annular in cross-section; and each spanning member securement retention fitting is a threaded fastener that, on installation, passes through the annular cross-section of the associated second member. In yet another further feature, the seat is upwardly facing and the consumable member is located below the seat. In a still further feature, as installed, the condition of the consumable member is ascertainable, and the consumable member is replaceable, while the beam end remains supported by the seat. In another feature, the combination includes beam engagement fittings, the beam engagement fittings is threaded fasteners, the accommodations defining slots, wherein, in use, the consumable member, the support fitting, and a beam end are stacked together in a sandwich, and the threaded fasteners secure the sandwich, the sandwich is in compression and the threaded fasteners is in tension.

In another aspect of the invention, there is a self-releasing beam end support assembly. It has a support fitting and at least a first consumable member and a second consumable member. The support fitting defines a seat upon which to support a beam end, and defines an anchor by which to attach the support fitting to a wall structure, and, once installed, by which to transfer ordinary loads from the beam to the wall structure. The consumable members and the support fitting has co-operating beam fastener accommodations. The support fitting has at least one engagement fitting interface. The first and second consumable members have respective first and second engagement fitting interfaces that, on installation, mate with the at least one engagement fitting interface of the support fitting to constrain location of the first and second consumable members relative to the support fitting. The first and second consumable members are each at least one of (a) thermally degradable; and (b) fire degradable. In operation, under a first, non-degraded condition of each consumable member, the support fitting and that consumable member are co-operable with at least one beam fastener to discourage dislodgement of the beam end from the seat. In operation, under a second, degraded, condition of each consumable member, (a) the support fitting remains operable to carry the static load, and (b) the support fitting and each consumable member are co-operable to permit release of the beam end from the seat under abnormal loading.

In a feature of that aspect of the invention, the support fitting engagement fitting interface includes at least one zone of asperities having a first footprint. The first consumable member has a first consumable member asperity footprint that, on installation, mates with at least a portion of a corresponding region of a zone of asperities of the engagement fitting interface of the support fitting. The second consumable member has a second consumable member asperity footprint that, on installation, mates with at least a portion of a corresponding region of a zone of asperities of the engagement fitting interface of the support fitting. The footprint of the support fitting engagement interface fitting is non-co-extensive with either respective footprint of the first and second consumable member asperity footprints. In another feature, the footprint of the support member includes regions that extend beyond the footprints of the consumable members. In another feature, the footprints of the consumable members include regions that extend beyond the footprint of the support member. In still another feature, the first and second consumable members are of the same shape and size, and have the form of cylindrical members of annular cross-section.

In another aspect of the invention, there is a combination of a firewall, a first self-releasing beam end support assembly and a second beam end support assembly as described in any of the aspects or features above, where one fitting extends from one side of the wall, and the other fitting extends from the other side of the wall.

BRIEF DESCRIPTION OF THE ILLUSTRATIONS

Figure 1B:
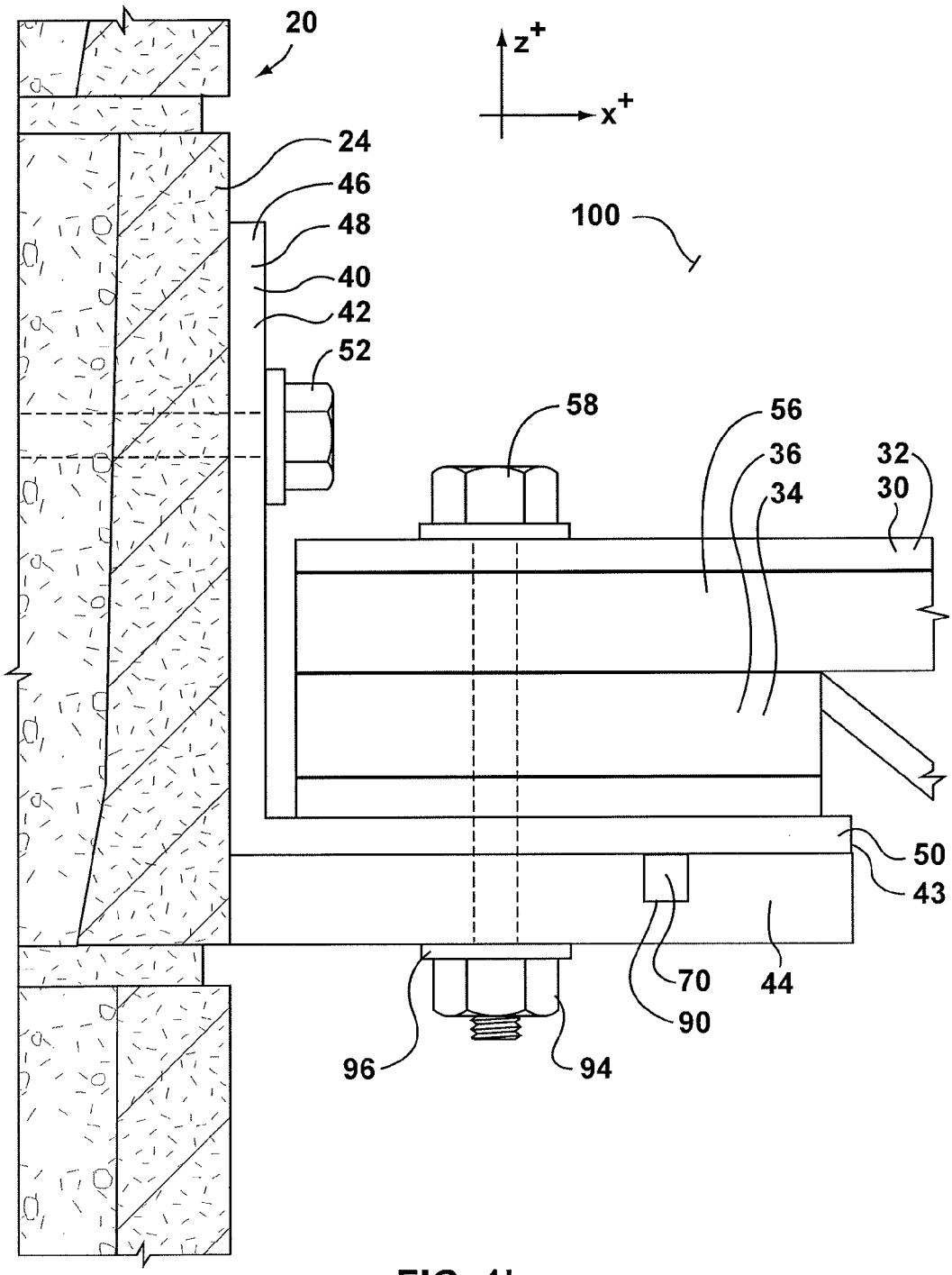

The foregoing aspects and features of the invention may be explained and understood with the aid of the accompanying illustrations, in which:

FIG. 1*a* is a general arrangement side view on a cross-section of a structural load-bearing firewall showing two beam end supports, including break-away connector support assemblies according to an aspect of the invention;

FIG. 1*b* is an enlargement of a detail of one of the beam end support assemblies of FIG. 1*a;*

Figure 2A:
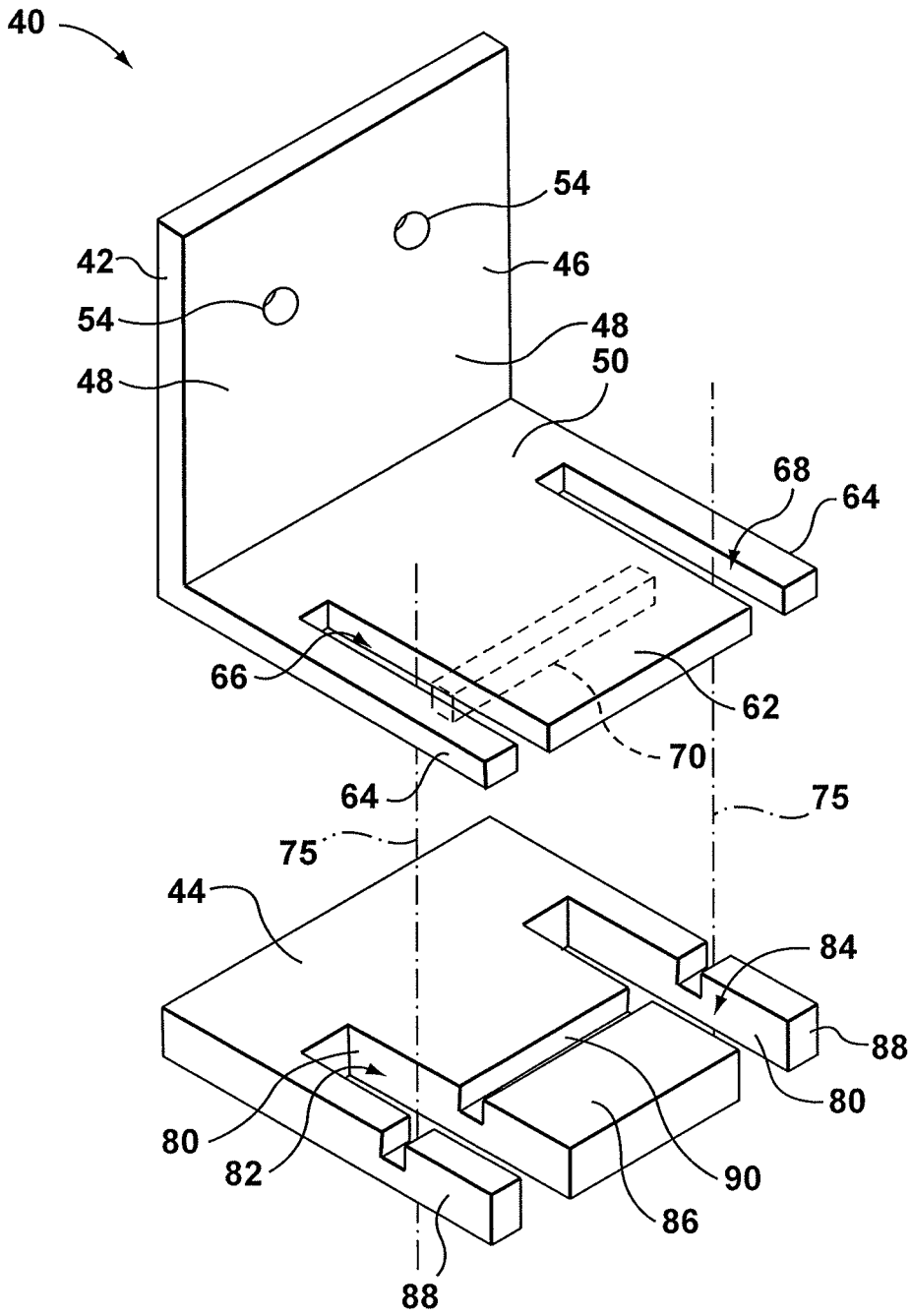

FIG. 2*a* is an exploded isometric view of parts of the break-away connector support assembly of FIG. 1*a;*

Figure 2D:
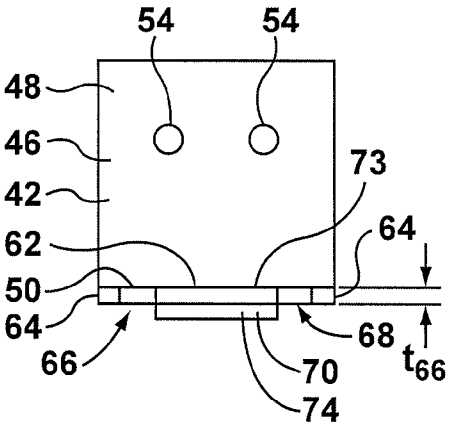
Figure 2C:
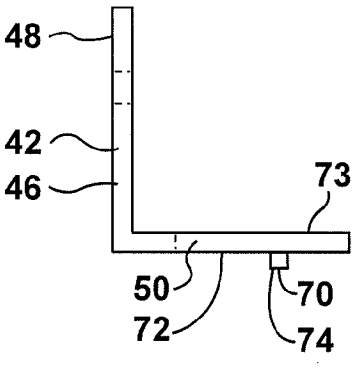
Figure 2B:
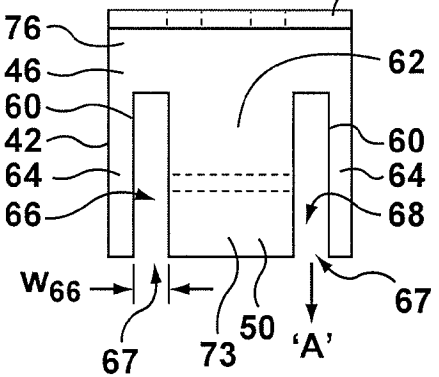

FIG. 2*b* is a top view of a bracket member of the assembly of FIG. 2*a;*

FIG. 2*c* is a side view of the bracket member of the assembly of FIG. 2*a;*

FIG. 2*d* is an end view of the bracket member of the assembly of FIG. 2*a;*

Figure 2G:
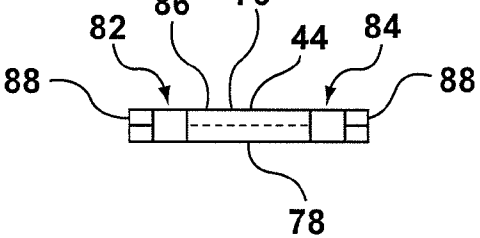
Figure 2F:
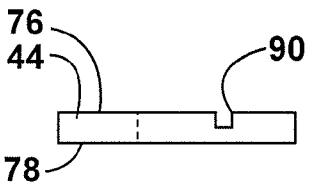
Figure 2E:
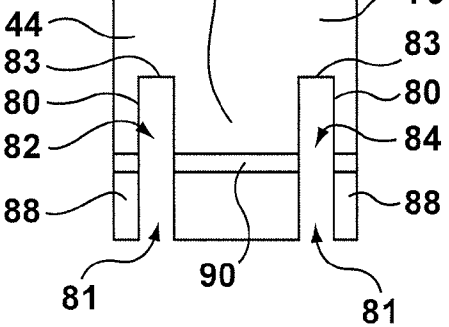

FIG. 2*e* is a top view of a slip plate member of the assembly of FIG. 2*a;*

FIG. 2*f* is a side view of the slip plate member of the assembly of FIG. 2*a;*

FIG. 2*g* is an end view of the slip plate member of the assembly of FIG. 2*a;*

Figure 2H:
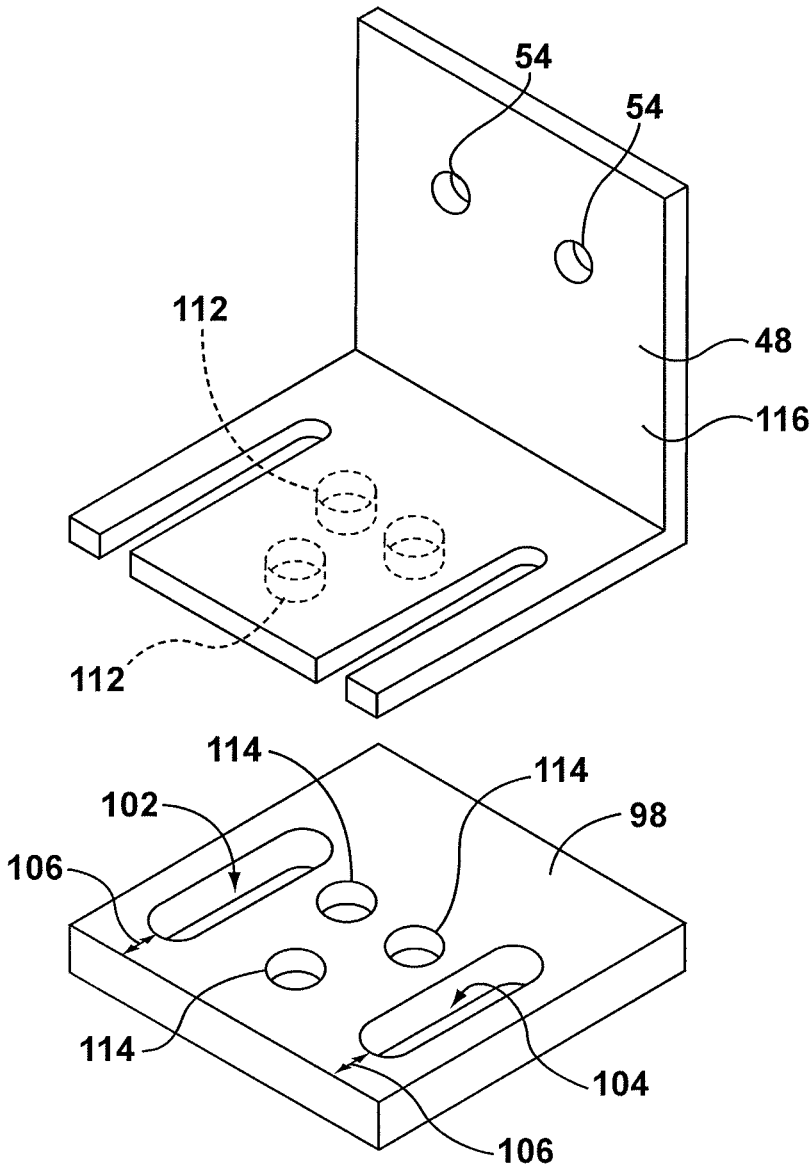

FIG. 2*h* is an exploded isometric view of an alternate embodiment of hanger bracket assembly of FIG. 2*a;*

Figure 3A:
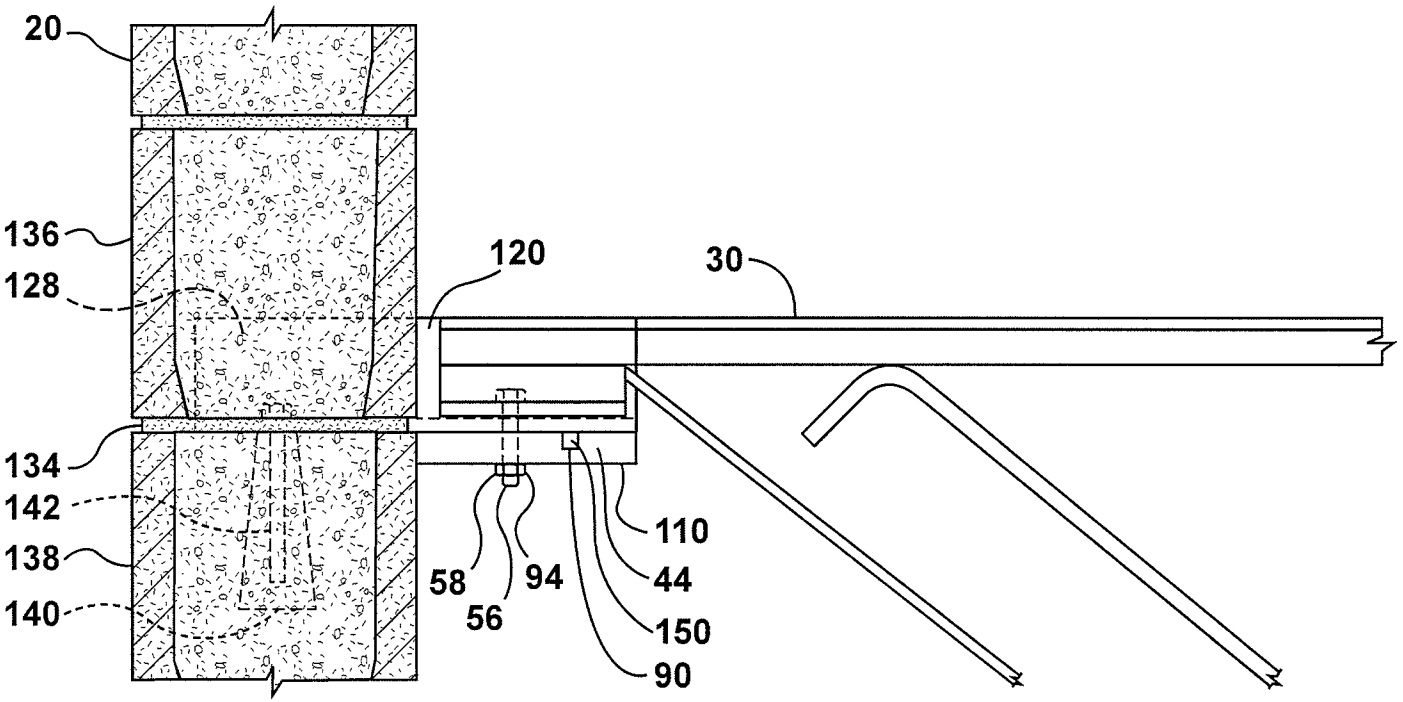
Figure 3B:
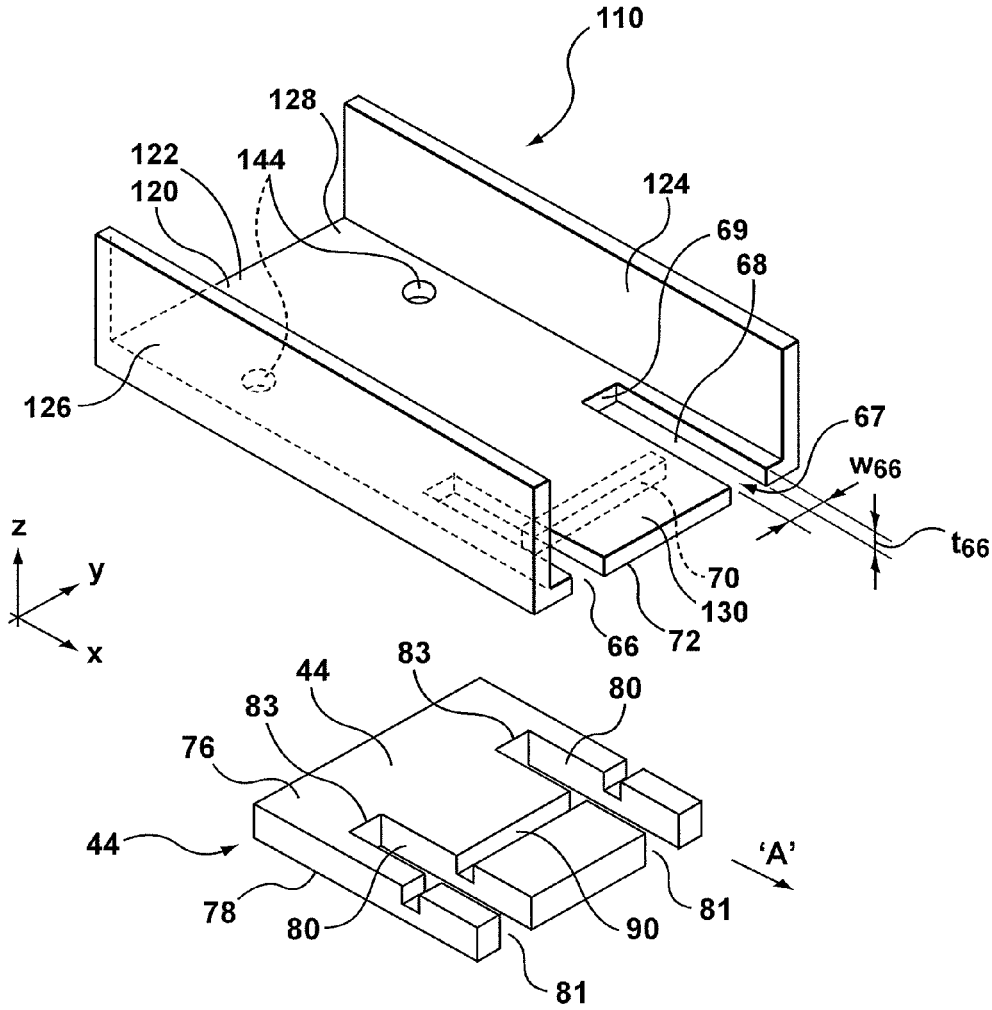
Figure 3C:
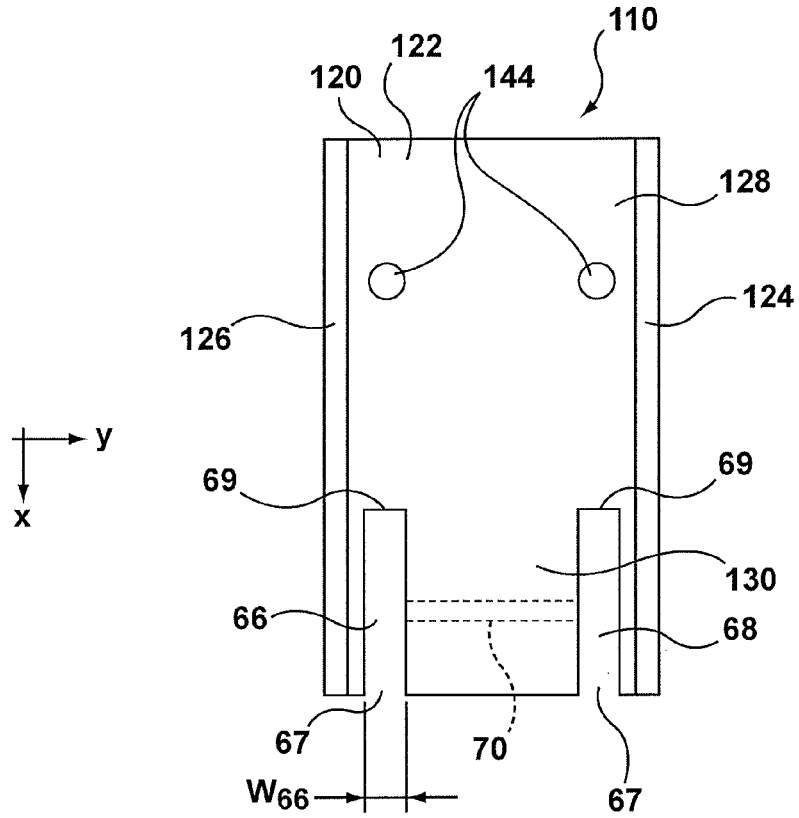

FIG. 3*a* is a general arrangement view through a cross-section of a structural load-bearing firewall showing an alternate break-away connector beam end support assembly to that of FIG. 1*a*, shown as assembled;

FIG. 3*b* is an exploded isometric view of parts of the break-away connector support assembly of FIG. 3*a* in an unassembled condition;

FIG. 3*c* is a top view of a bracket member of the assembly of FIG. 3*a;*

Figure 3D:
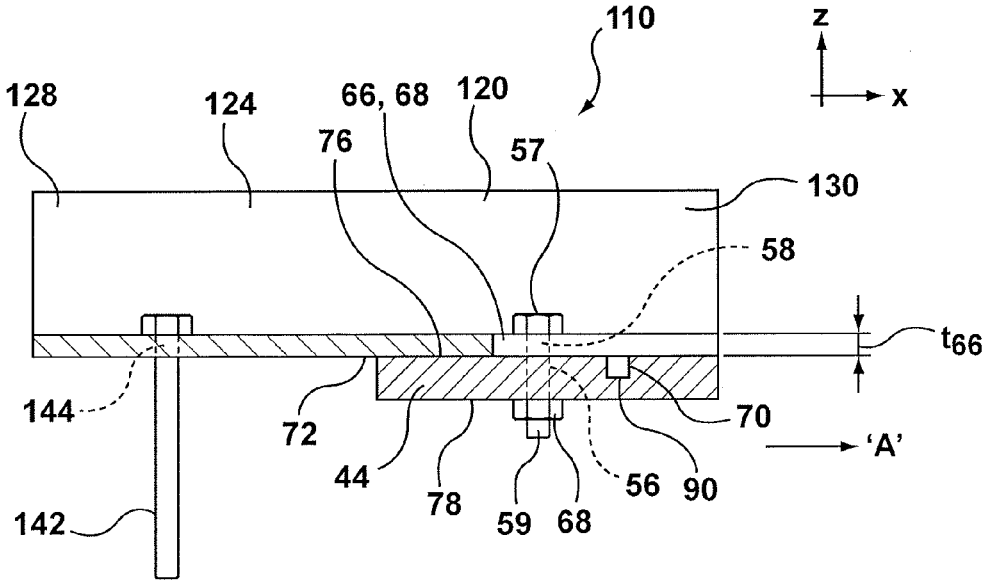
Figure 3E:
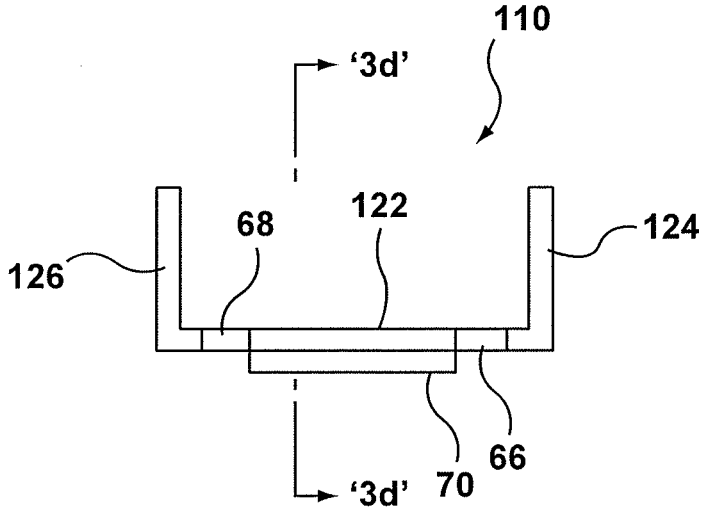

FIG. 3*d* is a sectional view of the assembly of FIG. 3*a*, as assembled, taken on section '3*d*-3*d*' of the member of FIG. 3*e;*

FIG. 3*e* is an end, or front, view of a bracket member of the assembly of FIG. 3*a;*

Figure 4A:
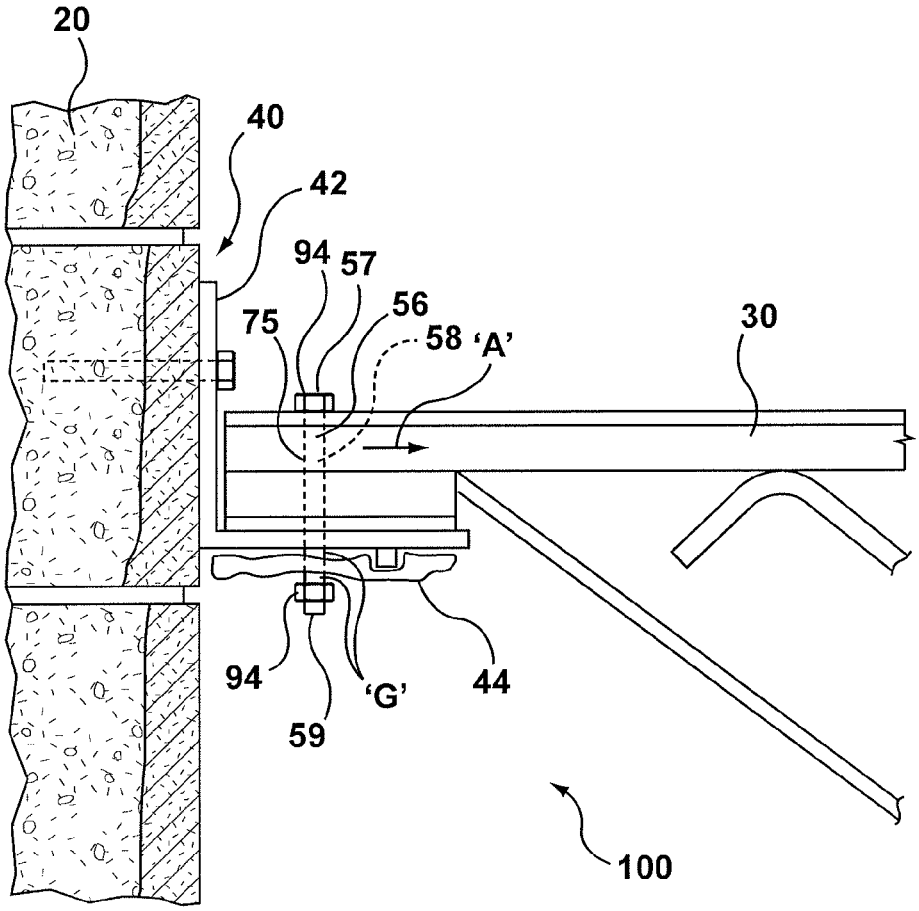
Figure 4B:
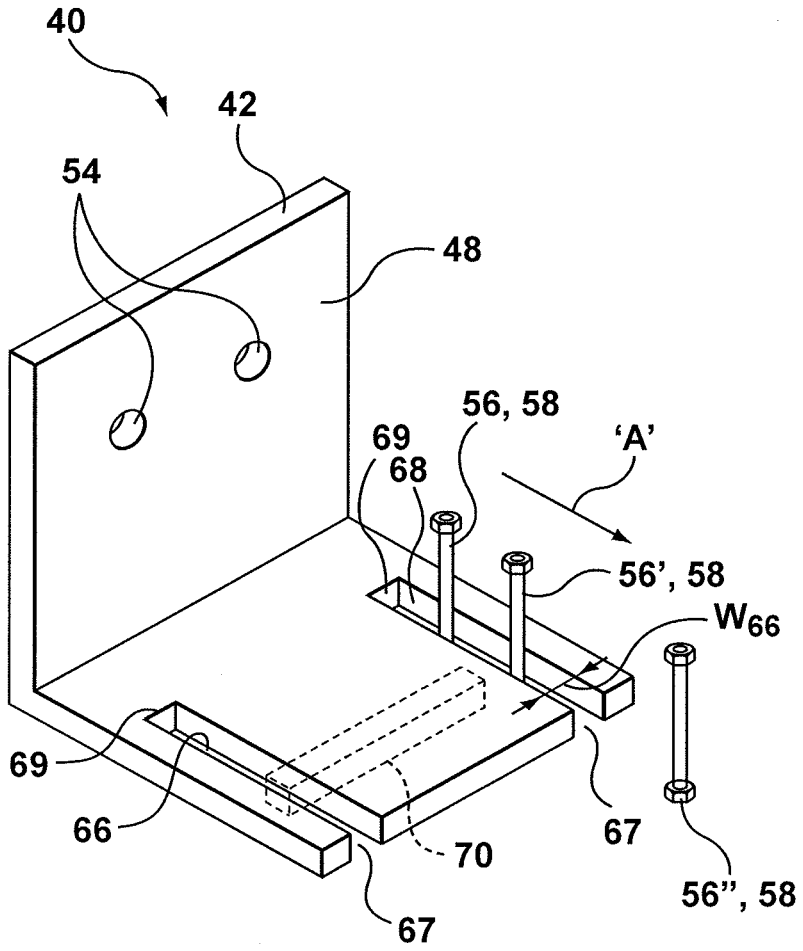
Figure 4C:
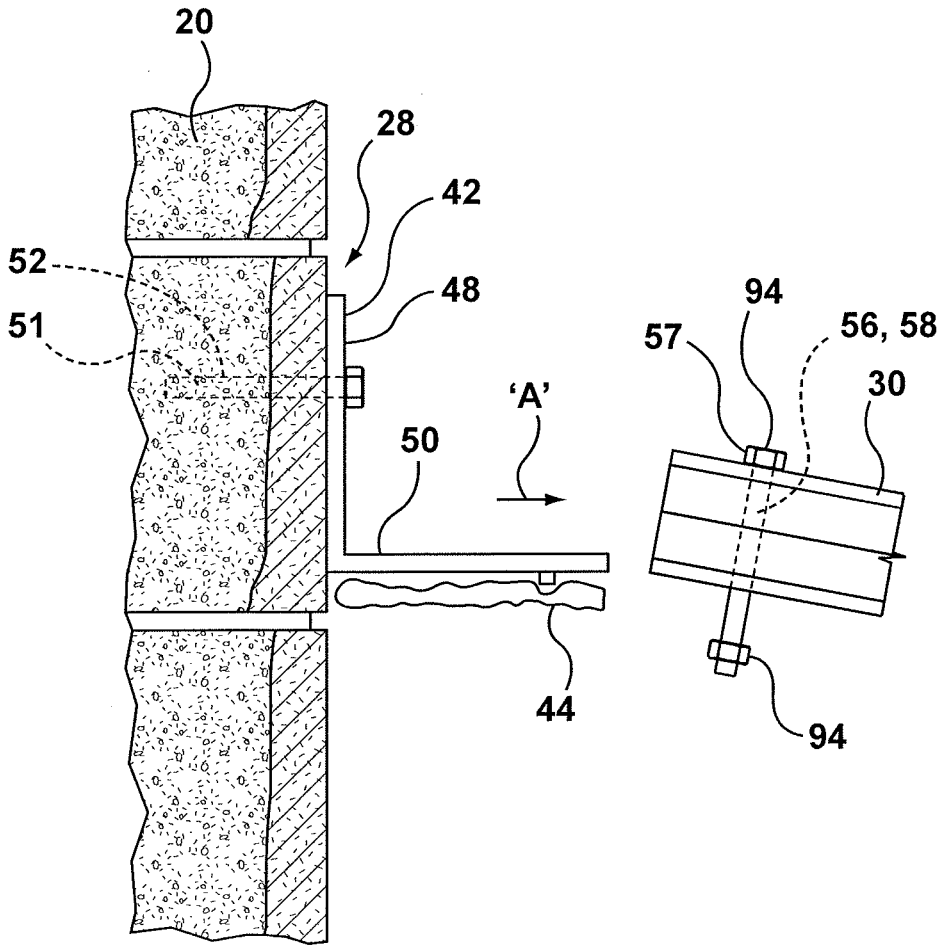
Figure 5A:
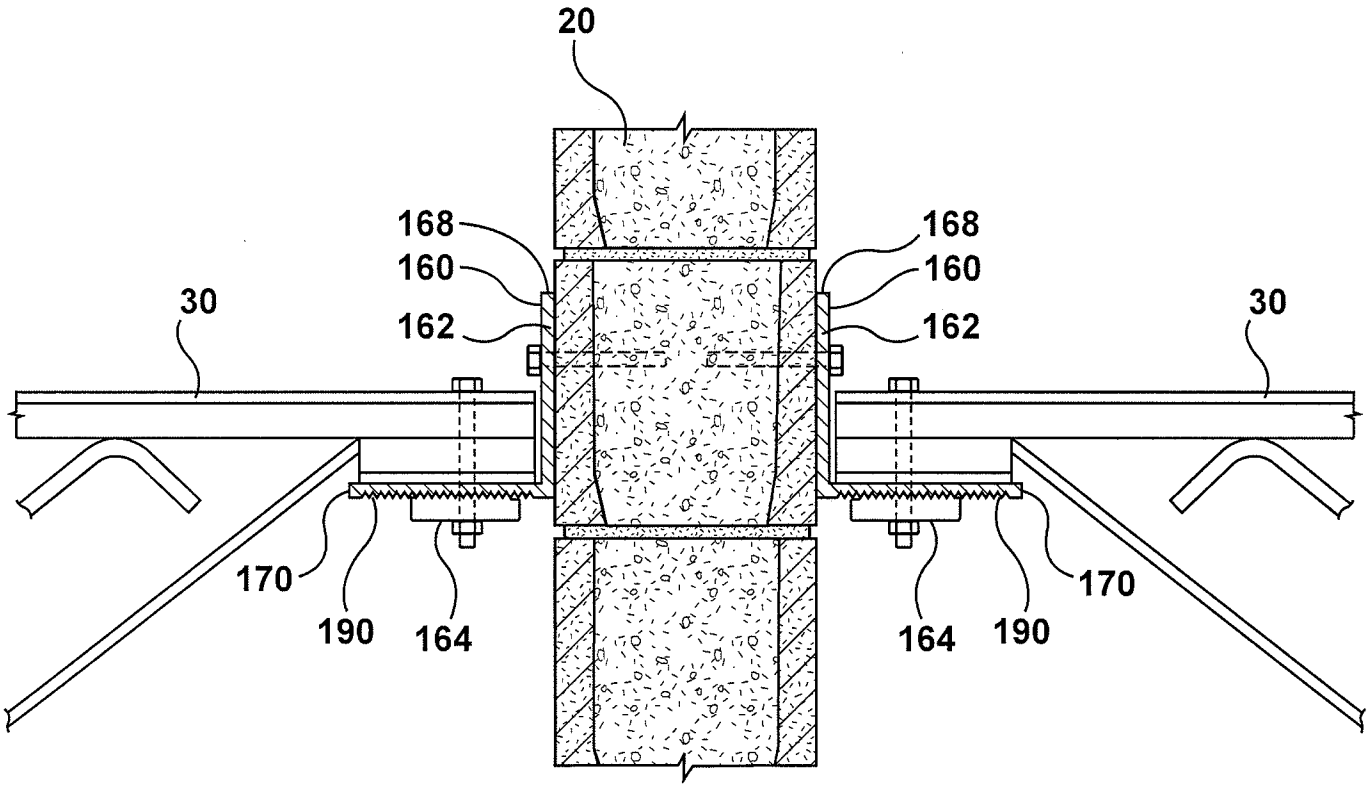
Figure 5B:
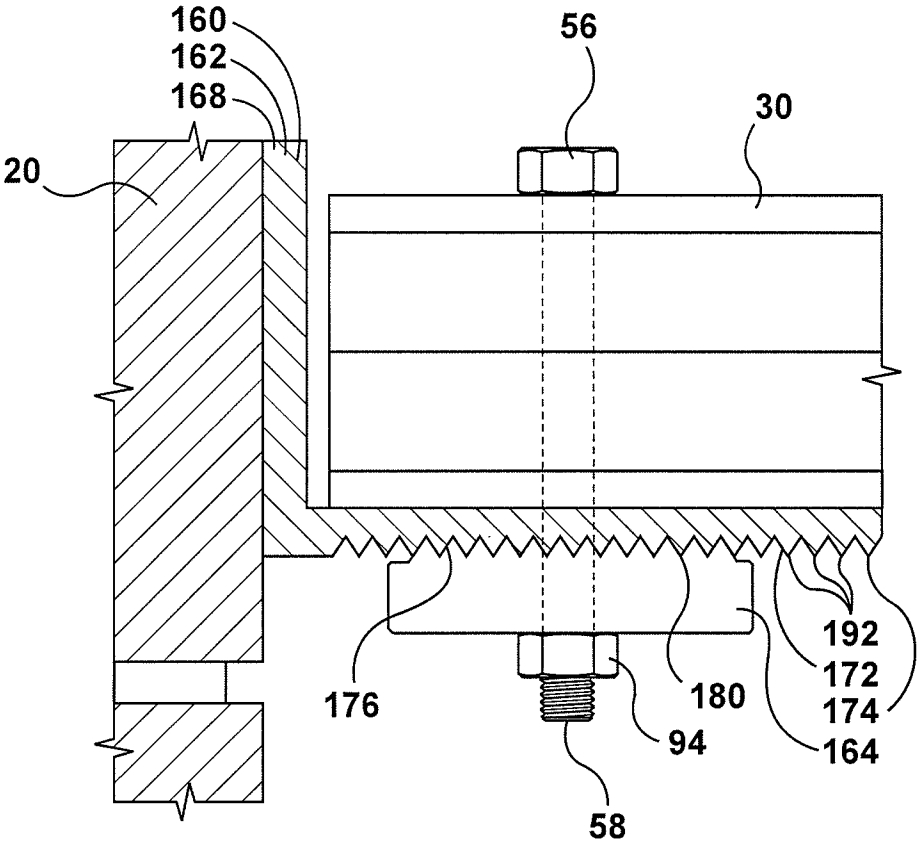

FIG. 4*a* is a side view of the break-away connector system of FIG. 1*a* when the fusible member is weakened by heat;

FIG. 4*b* is a perspective view of the support member of FIG. 2*a* showing a securing member extending through the support member and sliding through different positions relative to a channel of the support member;

FIG. 4*c* is a side view of a floor having been released from the break-away connector system of FIG. 1*a* after the fusible member has been weakened by heat;

FIG. 5*a* is a general arrangement view through a cross-section of a structural load-bearing firewall showing an alternate break-away connector beam end support assembly to that of FIG. 1*a*, shown as assembled;

FIG. 5*b* is an enlargement of a detail of one of the beam end support assemblies of FIG. 5*a;*

Figure 6A:
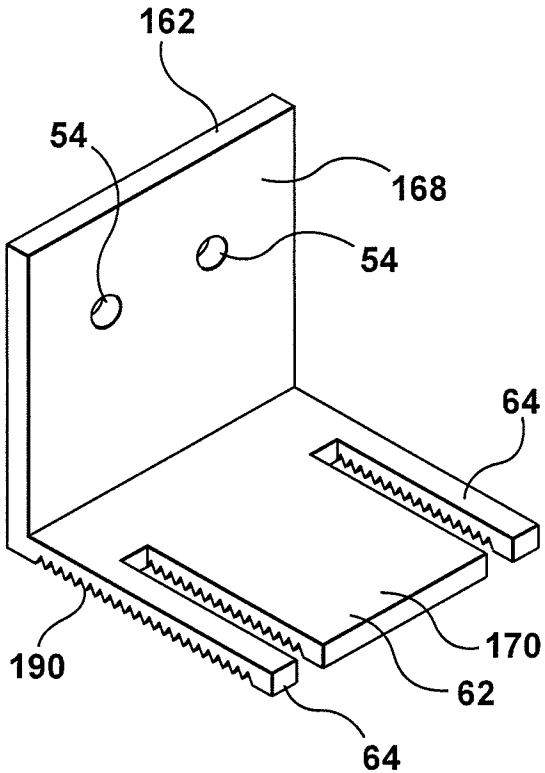

FIG. 6*a* is an isometric view the break-away connector support bracket of FIG. 5*a;*

Figure 6B:
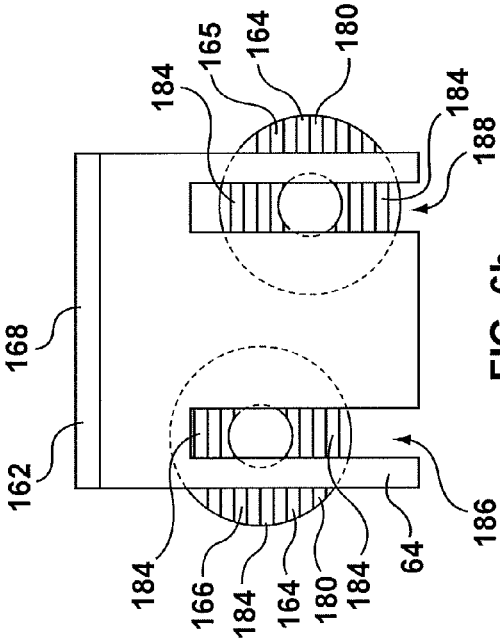

FIG. 6*b* is a top view of a bracket member of the assembly of FIG. 5*a;*

Figure 6D:
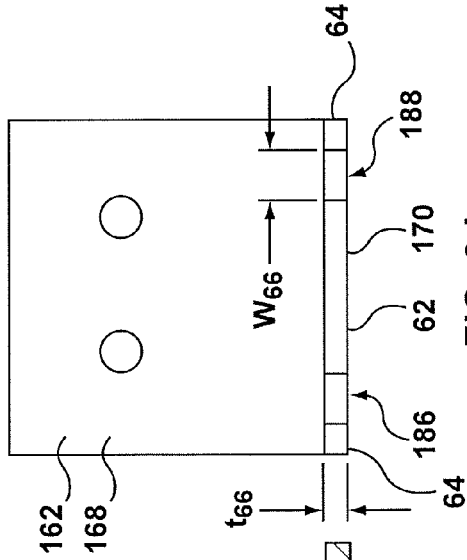
Figure 6C:
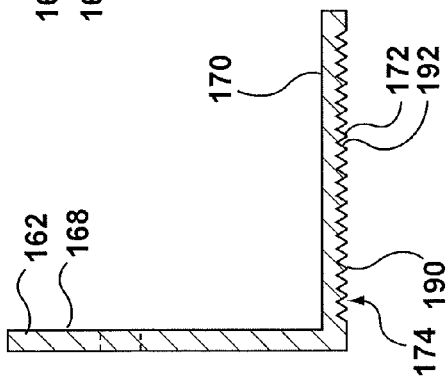

FIG. 6*c* is a side view of the bracket member of the assembly of FIG. 5*a;*

FIG. 6*d* is an end view of the bracket member of the assembly of FIG. 5*a;*

Figure 7A:
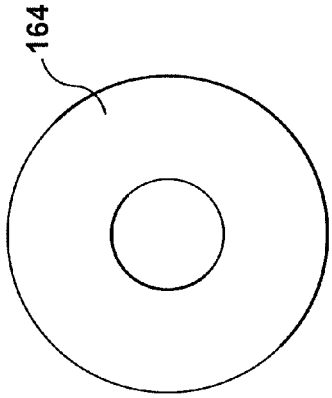
Figure 7B:
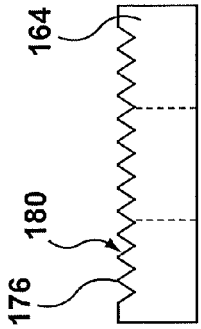

FIG. 7*a* is a top view of a slip plate member of the assembly of FIG. 5*a*; and FIG. 7*b* is a side view of the slip plate member of FIG. 7*a*.

DETAILED DESCRIPTION

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings may be taken as being to scale, or generally proportionate, unless indicated otherwise.

The scope of the invention herein is defined by the claims. Though the claims are supported by the description, they are not limited to any particular example or embodiment, and any claim may encompass processes or apparatuses other than the specific examples described below. Other than as indicated in the claims themselves, the claims are not limited to apparatuses or processes having all of the features of any one apparatus or process described below, or to features common to multiple or all of the apparatus described below. It is possible that an apparatus or process described below is not an embodiment of any claimed inventions.

The terminology used in this specification is thought to be consistent with the customary and ordinary meanings of those terms as they would be understood by a person of ordinary skill in the art in North America. Following from the decision of the Court of Appeal for the Federal Circuit in Phillips v. AWH Corp., the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of experience in the art.

Reference is made herein to fireproof materials. For the purpose of this specification, a material may be considered fireproof if its physical properties are such that it will neither catch fire nor melt below 600° C. Fireproof materials explicitly include metals such as are commonly used in building materials, such as iron, steel, nickel, copper, brass, bronze, aluminum, and such other various metal alloys as may be used commonly for construction materials. In the most common context, the fireproof material may be mild steel.

In this specification, reference is made to materials that are either flammable or that degrade in the presence of heat. For the purposes of this description, flammable means flammable under commonly occurring circumstances up to 500° C. This would include lignocellulosic materials, e.g., wood and paper based materials, and many hydrocarbon based plastics. For the purposes of this description, the term heat degraded or heat degradable means a material that loses properties pertaining to physical integrity when heated substantially above room temperature, e.g., heated well above 100° C. Those properties may include degradation as by melting, or by undergoing plastic deformation; it may include loss of yield strength or other forms of physical weakening.

Referring to the general arrangement of FIGS. 1*a* and 1*b*, there is a partial cross-section of a wall assembly 20, the wall assembly including, or being, a masonry firewall. Firewalls, such as firewall 20 may tend to limit the spread of fire or heat or products of combustion from one space to another. In this instance, firewall 20 may be taken as being a wall in an interior of a residential, industrial or commercial structure or building, and walls of this nature may define individual rooms within the structure or define a partition between adjacent structures. For the purposes of this description, it may be helpful to consider a Cartesian co-ordinate frame of reference. The vertical or up-and-down direction may be designated as the z-axis or z-direction. The perpendicular direction lying in the plane of the page may be considered as the longitudinal direction or x-direction or x-axis. The mutually perpendicular direction normal to the page, i.e., along the wall, may be considered the sideways direction, or y-direction or y-axis.

The masonry firewall 20 has some form of facing, 22. Wall assembly 20 is of some height. It starts at a level some distance below the section shown, and extends to a level some distance above the section shown. The masonry firewall 20 may be made of concrete, reinforced concrete, or masonry blocking such as concrete-filled cinder blocks, brick, and so on. It may have multiple layers, such as a double brick wall. The middle portion of the section in the z or vertical direction may be considered to be a course of cinder blocks, 24. The facing 22 may include a finishing material, of which a common example is a layer of gypsum board (not shown). In any case, whatever the facing material may be, even if it is the bare surface of concrete or cinder blocks, the wall has a surface, or face, 28. As may be understood, masonry firewalls 20 are often intended to be strong in the vertical direction, as they may be intended generally to carry vertical loads in compression. They may not be intended to transmit bending moments, and may not be intended to receive substantial transverse loads normal to the wall, the walls often being substantially planar with large height and width but relatively much thinner through-thickness (i.e., the through-thickness may be one or more orders of magnitude smaller than the other dimensions).

On either side of the wall assembly 20 (i.e., in the x-direction), there may be assumed to be floors or ceilings 29 (indicated in phantom), or substantially horizontal supporting platforms of one kind or another. These platforms are assumed to be supported in some way by span-wise extending support members 30, where the span-wise direction is taken as being the x-direction. For the purposes of this description, support members 30 may be termed support beams or trusses, or joists 32. These joists 32 may, for example, include non-flammable structural elements such as steel flanges and struts. There are many different kinds of possible joist members, including, but not limited to trusses, box beams, I-Beams, U-Channels, solid rectangular joists, laminated joists, and so on. The floor supported by the joists 32 may be made of one or more of wood, steel, concrete, reinforced concrete, composites or other flooring material. Joists 32 may have beam ends 34 that are flanged, as at 35. The lower flange may have the form of a flat, or tab, or finger 36. The beam ends 34 may also have an upper flange which may have an upper surface 37 at their uppermost extremity upon which the flooring or ceiling materials may be carried. In addition, beam ends 34 may also have a lower member, or lower flange, itself having an upper surface 38.

A cross-member end support, such as may be a self-releasing structural support assembly, may be identified as 40. Support assembly 40 may also be called, or may include, a break-away connectors system. Support assembly 40 may also be termed a joist hanger, or hangar bracket assembly. As seen in FIGS. 2*a*-2*g* support assembly 40 may include a first part, the support member of assembly 40, such as may be the hanger or bracket itself, or simply the hanger, identified as 42; and a second portion or second part, which may be a flammable or heat degradable member, or fusible member, or consumable member, however it may be termed or identified, any of those terms being acceptable for the item indicated as 44 herein. Hanger bracket 42 may have a disengagement end 43 facing generally toward beam end 34, and upon which, in use, beam end 34 might normally be expected to seat. It may be noted that while support assemblies 40 may be mounted on opposite sides of wall assembly 20, neither assembly traverses the wall structure, such that fire cannot be transmitted across the masonry wall by the fitting installation itself. The fusible or consumable member 44 may, in use, mount under disengagement end 43, and may have lower surface, or downwardly facing surface, 45, that may tend to be exposed to the ambient environmental conditions in the space beneath span-wise-extending support members 30.

The hanger or bracket 42 may have the form of an angle bracket 46 which may include a first portion or member or first leg, 48, that stands substantially vertically, and a second portion or member or section, or second leg, 50 that lies in a substantially horizontal plane. Hanger 42 is made of a fireproof material that will tend not to burn or suffer thermal degradation in fire conditions. For example, hanger 42 may be made of steel.

The first portion, first leg 48, is an anchor member. That is, first leg 48 is the portion of hanger 42 that is the base, or anchor, that, on installation, is permanently secured or otherwise attached to the fireproof structural reference datum member such that loads carried by hanger 42, namely the vertical shear load introduced by the end of the spanning member, are transmitted into the reaction member, namely the masonry wall. The structural datum member in this example is the fireproof wall assembly 20. The connection may involve mechanical embedment of a portion or all of the anchor member into the masonry wall, or it may involve the use of an attachment member 51, such as may be or include mechanical securement hardware or other fittings, of which an embedded anchor bolt, or laterally spaced apart anchor bolts, 52 may be taken to be generically representative. To that end first leg 48 may have an anchor or attachment fitting, or fittings, such as apertures or bores 54 (FIG. 2*a*) that are laterally spaced from each other. In this embodiment, first leg 48 may be a substantially vertically oriented leg of an angle iron, as shown.

The second portion, or second section, second leg 50, is a short cantilever beam whose length is of a magnitude roughly comparable to its width. In the embodiment shown, second leg 50 extends at a right-angle to first leg 48, and square (i.e., level and horizontal, and normal or orthogonal) to wall 20. This need not necessarily be so, although it may be convenient in many instances. Leg 50 defines a reaction seat upon which to carry the foot, or toe, or tab, or tang or end 34 of spanning member 30, and through which to receive the vertical shear load from spanning member 30. There will, typically, be a mechanical fastener, or link, or pin, fitting, or connector that in some way secures the end of the spanning member to the support bracket. In the example illustrated, the flanged end 56 may have suitable bores for mechanical retainers in the form of threaded fasteners such as may be identified as bolts 58, each having first and second ends 57 and 59. Second leg 50 may have spanning member securement fitting accommodations 60 in FIG. 2*b* that align with, and receive, those retention fittings. In the example illustrated, second leg 50 has a central portion 62 and two flanking fingers, 64, that extend parallel to central portion 62, but are laterally spaced from it such as to leave two laterally spaced apart slots 66, 68 that define accommodations 60 in this embodiment. Slots 66, 68 may be closed at their inner or proximal closed ends 69 close to first leg 48, and are open at their far or distal ends 67 distant from first leg 48. The length of slots 66, 68 provides a range of dimensional tolerance of variation of position in the x-direction, namely the spanning direction perpendicular to the wall, of the end of the spanning member. That range may typically be +/−1 inches to either side of center, giving an overall range of at least 2 inches. In addition, these slots are also open in the end direction, such that bolts 58 can, unless otherwise discouraged, slide out in the x-direction. Each of slots 66, 68 has a width, $W_{66}$, suitable for sliding passage of the shanks of bolts 58, and a height the same as the through-thickness of the second leg, $t_{50}$.

Second leg 50 also includes a support member engagement member, or retainer, or retention fitting or first indexing member 70, which may have any of a multitude of physical forms but may, in one example, have the form of a short length of rod or bar 74, welded cross-wise to the bottom surface, or underside, or under-surface, 72 of leg 50. Second leg 50 also has a top surface, or upper surface, 73. In other embodiments, indexing member 70 might have the form of a round plug or blister, or a pattern or array of such protuberances (indicated in phantom as 112 in FIG. 2*h*) extending proud of the otherwise generally horizontal planar under-surface 72 of leg 50. In normal use, beam end 34 of spanning member 30 may sit on the upwardly facing surface or side 73 of leg 50.

Second part or member 44 may, as noted, be a flammable or heat degradable member. It has an upwardly facing side or surface, or upper surface 76, and a downwardly facing side or surface 78. It may, generally speaking, have a plan form or footprint conforming to, or otherwise suitable for co-operation with, the under-surface 72 of leg 50. It may be convenient that this footprint of surfaces 76 and 78 be substantially square or rectangular and correspond in length and width to leg 50 of bracket 46. Second member 44 is made of a material that is either (a) fire degradable; or (b) temperature degradable. That is, when exposed to either sufficient heat or to open flame, the structural integrity of second member 44 diminishes, and its yield, modulus, or strength may lessen, and it may undergo plastic deformation. Second member 44 has a body that has a spanning member securement retention fitting, openings or fittings 80, that is, or are, formed therein, those fittings being co-operable with spanning member securement accommodations 60. For example, where fittings 60 are slots 66, 68, openings or fittings 80 may also be openings or slots, 82, 84, correspondingly shaped and spaced between a central portion 86 and laterally spaced fingers 88. In one embodiment, slots 82, 84 may be open-ended at the open end 81 most distant from first leg 48 of bracket 46, and closed ended at closed end 83 proximate to first leg 48.

Second member 44 may be termed a slip plate. Second member 44 has a retainer or x-direction retention fitting, or fusible member engagement member, or indexing member, or groove, 90, however it may be termed, that is of a size and shape matingly to engage the retention or indexing member 70 of first member 42. In the embodiment illustrated, indexing member 90 may have the form of a slot, or rebate, or depression, or groove, that is the negative image of and thereby defines an accommodation for member indexing member 70. It is to some extent arbitrary which of indexing members 70 and 90 is termed the male member, and which is termed the female member. The two parts engage, and when so engaged the two parts cooperate such that second part, member 44, is inhibited from movement in the release or x-direction. When parts 44 and 50 are engaged as shown in FIG. 1*a*, the openings or slots 66, 68 and 82, 84 are generally lying overtop of each other, respectively, such that they are aligned in the z and y directions, and thereby co-operate to define respective first and second vertical passageways 75 through parts 44 and 50.

In the alternate embodiment of slip plate 98 of FIG. 2*h*, slots 102, 104 are apertures formed through the body of slip plate 98. Apertures 102, 104 have a closed periphery or closed peripheral wall. Between the distal end of the slots 102, 104 and the end of the slip plate 98 is a small portion of material, or a membrane, designated as 106, membrane 106 being frangible when slip plate 98 has been exposed to high heat or open flame and the tension and compression in the bolted sandwich assembly has been released.

The second embodiment consumable member, slip plate 98, may have retainers, or retention or indexing fitting such as indexing member 90, or it may have such other pattern of indexing members as may suit. For example, slip plate 98 may have an array of rebates, or defects, or hollows or depressions, such as may be identified as sockets or receptacles 114 as shown in FIG. 2*h* for receiving protuberances 112 of alternate bracket 116.

When assembled, the end of spanning member 30 sits on the seat defined by upper surface 76 of cantilevered leg 50 of bracket 46. The end fasteners, such as threaded bolts 58, pass through the bores in the end of the spanning member, through slots 66, 68 in leg 50, and through slots 82, 84 in second member 44. In the resultant sandwich, bolts 58 are secured in place by nuts 94 which may also bear against a washer or a load-spreading keeper plate 96. Nuts 94 are then tightened to impose tension in bolts 58 (and corresponding compression in the sandwich) such that there is a suitable friction load between the end of spanning member 30 and supporting bracket 46 to retain the end 34 of spanning member 30 in place. In normal circumstances, under ordinary loading conditions there should not be any longitudinal, or x-direction, load that would tend to urge spanning member 30 to disengage. The static load is most typically a vertical shear load, and, in buildings, live loads may tend also to be vertical loads. For structural purposes, the connection between the spanning member and the structural support assembly may be modelled as, and can be considered herein to be, a pin jointed connection that transmits vertical shear, but not a bending moment, between spanning member 30 and wall assembly 20.

In the event of a fire, such as may cause spanning member 30 to collapse, it is desirable for spanning member 30 to disengage from wall assembly 20 rather than remain engaged and tend to pull wall assembly 20 down with it. In that light, the bolted connection may be considered a sandwich under a mechanical spring pre-load, in which bolt 58 functions as a longitudinal spring in tension, and members captured between nut 94 and the head of bolt 58 function as an opposed longitudinal spring in compression. As long as this relationship persists, the connection will tend to inhibit disengagement of the spanning member from the bracket—e.g., by linear translation in the x-direction.

In the event that there is a fire in the adjacent zone, identified notionally as an interior space or room 100, and second part 44 is exposed either to open flame or to elevated temperatures for a sufficient period of time (e.g., 350+° F. (180° C.) for 10 minutes or more), the structural integrity of part 44 degrades, such that the compressive stress in the sandwich (and therefore the tensile stress in bolts 58) is released. This may occur because part 44 melts, or crumbles, or burns, as may be. When the preload in the sandwich and bolt combination is thereby lost, the end of the spanning member can pull out. (In the alternate embodiment of FIG. 2*h*, this motion would tend then to tear frangible membrane 106.) Second part 44 (or 98, as may be) can in that sense also be termed a sacrificial member.

Second part 44 can also be thought of conceptually as a thermal fuse. When a thermal overload condition occurs, the fuse melts (or otherwise degrades), and the spring load in the mechanical sandwich relaxes, thereby diminishing or eliminating the retention capability or function of the connection. When the fuse has been activated thusly, end 34 of spanning member 30 is disengageable along the degree of freedom of longitudinal translation in the x-direction away from the structural datum member, namely the wall structure. End 34 continues to be inhibited by the slots from freedom of motion in the y-direction, and by the plate itself, i.e., leg 50, in the z-direction. Of course, that the thermal fuse, member 44, has undergone thermal degradation, thus permitting motion along the sliding translational degree of freedom, does not mean that the beam will necessarily disengage. It may continue to be supported by hanger 42, carrying the ordinary loads in the ordinary manner. The mere degradation of the fuse is a necessary, but not sufficient, prerequisite condition for disengagement to occur. However, if that condition is met, and there is then applied a lateral load, or component of load or other cause to urge the end of the beam to disengage in that lateral, or normal, or cross-wise direction relative to the wall structure, disengagement will follow. Where degradation occurs, but is not followed by disengagement (the fire is safely extinguished in good time, for example), the consumable or degradable member no longer serves to prevent lateral motion. However, in as much as the consumable member remains exposed and therefore accessible for inspection, it can be replaced as appropriate. Since the consumable member is on the outside, below the load bearing bracket, it can be removed and replaced while the beam end remains in place on the bracket.

In an alternate embodiment, shown in FIG. 2*h*, the sacrificial or consumable member could be placed between the bracket and end 34 of the spanning member 30. However, in the embodiment illustrated, there is no separation, or sacrificial member, between the spanning member and the seat on the support bracket. Rather, the foot (i.e., end 34) of spanning member 30 is above, and rests upon seat (i.e., leg 50), and the fuse or degradable member 44 is carried below, or on the underside of, the seat. Thus, even if the fuse is activated, spanning member 30 will not necessarily move. It may stay in place on support bracket 46, as before, without any movement. Alternatively, a non-degrading gasket or shim, which may be thermally or electrically insulating, may be placed between end 34 and cantilevered leg 50 as, for example, when adjustment of end 34 is desired to level spanning member 30.

As noted above, if, on investigation, inspection shows that one of the fuses has, for example, melted, or that the tension in bolts 58 has been lost, indicating physical degradation of second member 44, then bolts 58 can be loosened, the worn out member 44 removed, a new "fuse" member 44 installed, and bolts 58 re-tightened to an appropriate value of tension. This replacement may tend to be considerably less difficult than if the sacrificial member were between the spanning member and the seat.

In the alternate embodiment of FIGS. 3*a*-3*e*, rather than being a bracket, a support assembly 110 includes a first part or base member that may have the form of a channel, 120, and a second part that may be substantially the same as second part 44 of assembly 40. Channel 120 includes a back 122 and pair of opposed sidewalls indicated as left and right hand legs 124, 126 laterally spaced apart a sufficient distance to accommodate the end of spanning member 30 therebetween. Lengthwise, channel 120 has a first section or first portion 128 and a second section or second portion 130. First section, or first portion 128 is embedded in firewall 20 in a built-in connection, with back 122 being located, for example, in the midst of a layer of mortar 134 between cinder blocks 136, 138. To aid in embedding this mounting, a threaded socket 140 may be captured in the concrete fill, and a threaded fastener, or fasteners, 142 may pass through apertures or bores 144 in first part 128, thereby fixing it in place.

Second portion 130 is the cantilevered overhanging end of channel 120 that protrudes from firewall 20. Second portion 130 has slots that may be substantially the same as slots 66, 68 in terms of function and general geometry or geometric relationship. Second part 130 also has an indexing or slip plate retention member, or retainer, 150, which may have any of the forms discussed above, whether a detent, or plug, or blister, or rod, or other form. Second part 44 mates with first part, 120, as described above. On assembly, bolts 58 and nuts 94 can be used as before. As installed and assembled, the end of the spanning member sits in the channel, and its vertical load is passed into the channel section and into the wall structure. As before, the connection is not intended to transmit a bending moment, and may be analysed as a simply connected pin joint. The ordinary load is a static gravity load, the direction of that load, as above, most typically being vertical and parallel to the wall surface. Second portion 130 is oriented to support the normal load without the beam moving, even if there is no fuse member in place. In operation, the failure of the fuse is again intended to permit spanning member 30 to pull away from wall assembly 20. And, again, as noted above, degradation of the fuse is a necessary, but not sufficient, pre-requisite condition for disengagement of the beam from channel second portion 130.

In assembly 110, as in assembly 40, notwithstanding degradation of the fuse, the structure maintains its integrity in respect of bearing loads in the z or vertical direction, and also maintains its integrity in preventing or restraining escape in the direction along the wall in the y-direction. Disengagement occurs when there is a further lateral force, an abnormal, or dislocating, or disengaging force, normal to, or transverse to, or cross-wise to the wall structure, resulting in displacement of the beam end in translation away from the wall structure in the direction of the degree of freedom permitted by the degradation of the fuse. Again, the fuse is located outside the back of the channel second portion 130, such that it is exposed for inspection, accessible for inspection, and accessible for replacement. As above, replacement can take place without the end of the spanning member being disengaged from the seat defined by channel second portion 130.

Although specific embodiments have been shown and described, the features of the various embodiments may be mixed-and-matched as may be appropriate. Channel 120 may have an array of retention or indexing features such as items 112 of FIG. 2*h*, and may be used in conjunction with a slip plate having slots with closed peripheries, as may be. The mounting hardware may pass through the full depth of the beam ends, or merely through the bottom flange or flanges of the beam. The slip plate may have closed ended slots, and yet use an indexing accommodation such as item 90. Such other combinations and variations of the features shown and described herein may be used as suitable without need of proliferation of illustrations and redundant explanation of each combination or permutation.

In summary, then, there is a self-releasing structural support assembly. It has a first member and a second member. The first member is made of a fireproof material. It has a first portion and a second portion. The first portion of the first member defines an anchor member by which the first member can be permanently secured to a structural reference datum member, the firewall, and through which, when installed, a shear load can be passed into the structural reference datum member. The second portion of the first member defines a reaction seat upon which to carry a foot of a spanning member and through which to receive a shear load from the spanning member. The second portion of the first member has a spanning member securement accommodation. The second portion of the first member has a first indexing member. The second member is one of (a) fire degradable; and (b) temperature degradable. The second member has a spanning member securement retention fitting that is co-operable with said spanning member securement accommodation. The second member has a second indexing member. On installation, the second indexing member of the second member is in mating cooperation with the first indexing member of the first member. In operation, when so mated, the second member is secured in a position preventing disengagement of the spanning member. In operation, when the second member is degraded by either one of (a) fire and (b) heat, the spanning member is insecure from disengagement from the first member.

In the embodiment of self-releasing structural support assembly shown, when installed, the seat is upwardly facing and the consumable member is located below the seat. As installed, the condition of the consumable member is ascertainable, and the consumable member is replaceable, while the beam end remains supported by the seat. The support fitting is mountable to a substantially planar wall, and, when mounted thereto, the beam fastener accommodations of the support fitting have a degree of freedom of linear translation substantially normal to the wall, and the seat has a range of accommodation position for the beam end along said degree of freedom. In some embodiments, the range of accommodation is at least 2 inches long.

The support fitting may be one of: (a) an angled member having a first leg for mounting to a wall, and a second, cantilevered leg that stands outwardly of the wall when the first leg is mounted thereto; and (b) a channel member having two legs and a back extending therebetween, such that when the channel member is embedded in a wall the back thereof is substantially horizontal and defines the seat. There may be embedment anchor hardware, and the anchor member may have fittings defined therein cooperable with the hardware. The beam engagement fittings may be threaded fasteners. The accommodations may have the form of slots, wherein, in use, the consumable member, the support fitting, and a beam end are stacked together in a sandwich. The threaded fasteners secure the sandwich in compression, the threaded fastener or fasteners being in tension.

The support member may be one of: (a) an angled member having a first leg for mounting to a wall, and a second, cantilevered leg that stands outwardly of the wall when the first leg is mounted thereto; and (b) a channel member having two legs and a back extending therebetween, such that when the channel member is embedded in a wall the back thereof is substantially horizontal and defines the seat. The support fitting is mountable to a substantially planar wall, and when mounted thereto, the beam fastener accommodations of the support fitting includes at least a first slot, that first slot having a degree of freedom of linear translation substantially normal to the wall, and the seat has a range of accommodation position for the beam end along that degree of freedom. When installed, the seat faces upwardly and the consumable member is located therebelow. As installed, the condition of the consumable member is ascertainable. The consumable member is replaceable while the beam end remains supported by the seat. In ordinary loading, the support assembly is operable to transfer vertical loads of the beam into the wall structure. In the degraded condition of the consumable member, the end support assembly remains operable to transfer the vertical loads, yet also permits a degree of freedom of motion of the beam end normal to the wall whereby the beam end can move away from the wall.

To recap, FIG. 1*a* shows floor or ceiling support 30 coupled to firewall 20 by break-away connector system 40 in a normal, assembled, state, in the absence of a heat-inducing event, such as a fire or explosion, within interior space 100. Support member 42 is an angle having a first section 48 and a second section 50. In some cases, support member 42 is fixedly secured to firewall 20. When support member 42 is an angle, first section 48 may be fixedly securable to face 28 of firewall 20 by attachment member 52, as shown. Attachment member 52 may pass through first section 48 of support member 42 and into the firewall 20, to attach the support member thereto, including through any gypsum board layer, and into masonry block 24, thus fixedly coupling attachment member 52 to firewall 20. In some cases, attachment member 52 can be placed into uncured concrete that, once cured, will form at least part of firewall 20, becoming securedly embedded into firewall 20. Alternatively, attachment member 52 may be drilled, screwed, or hammered into firewall 20 after the firewall has cured, by such means as may be appropriate. For example, attachment member 52 may include a screw, a high strength industrial adhesive, or the like. First section 48 of support member 42 may define at least one aperture 54 for receiving attachment member 52 therethrough, to couple support member 42 to firewall 20. In some embodiments, first section 48 defines a plurality of apertures 54, each of which is capable of receiving attachment member 52 therethrough.

Support member 42 may have at least one channel, such as slot 66 or 68, each of which has an open end 67 at disengagement end 43. Support member 42 may have one or a plurality of such channels. Each channel may be elongate, yet having an open end whatever its geometry, be it rectangular, semicircular, semi-elliptical, or box-shaped configuration with three equal wall-portions and a fourth open or partially open end. When there are multiple channels having an elongate shape, they may extend substantially parallel to one another to facilitate the slidable release of securing member 56 therefrom. Each channel may have a closed end 69 that opposes open end 67 and extends entirely through the thickness dimension $t_{50}$ of second section 50, as shown. In some embodiments, support member 42 has a support member engagement member 70 for mating with fusible member 44. Support member engagement member 70 may be or include a protrusion, which may extend downwardly from the bottom surface 72 of support member 42. Support member engagement member 70 extends at an angle, or cross-wise, to channel 66, 68, and may have an elongate axis that extends substantially orthogonal to the elongate axis of each channel. Support member 42 may be made of metal, such as steel, or at least one high melting-point alloy material such as tungsten or nickel, or other suitable metal.

As shown and described, the fusible member, part 44 has at least one opening such as slots 82, 84, therethrough, and may have a plurality of such openings. The number of such openings may match the number of slots or channels in support member 42. As assembled, at least one opening 82 or 84 is alignable with a channel or slot 66, 68 of support member 42 so that securing member 56 may pass through both support member 42 and fusible member 44. Each respective opening 82 or 84 is alignable with a channel or slot of support member 42. When an opening of fusible member 44 is aligned with a channel or slot of support member 42, a passageway 75 is defined through the fusible member 44 and support member 42. As assembled, securing member 56 extends through passageway 75. At least one securing member 56 is extendable through opening 80 of fusible member 44 and channel 66, 68 of support member 42. One or more securing members 56 is, or are, extendable through each opening and channel or slot 66, 68. Each securing member 56 may extend transversely, i.e., in the vertical direction normal to the plane of, second section 50 of support member 42. The dimensions of slots 82, 84 may be substantially similar to, or the same as, channel 66, 68. In some cases, as in FIG. 2*h*, opening 80 may be an enclosed aperture that does not have any open ends.

Fusible member 44 may be made of a material that has a lower melting point than support member 42, and is made of a material that is weakened by heat. Fusible member 44 may be made of a plastic material. Fusible member 44 may be made of aluminum. Fusible member 44 may also be or include a low-melting point alloy materials containing, for example, bismuth, tin, cadmium, zinc or indium. As non-limiting examples, the fusible member 44 may be made of material that weakens by melting, shriveling, cracking, shattering, contracting, softening, buckling, burning, disintegrating or any combination thereof when subjected to sufficient heat. Fusible member 44 weakens when subjected to heating above its melting point, that melting point below the temperature generated by a typical fire within an interior space.

Fusible member engagement member 90 may include a groove, which may be located in the top surface 76 of fusible member 44. That groove may extend obliquely, i.e., at an angle, or cross-wise, to the open-ended channel be it 66 or 68. The elongate axis of the groove may extend substantially orthogonal, i.e., perpendicular, to the elongate axis of opening 80, as shown.

When the support member, be it 42, and the fusible member, be it 44, are moved towards one another, e.g., as by vertical engagement, fusible member 44 may be lockingly securable to support member 42. Support member 42 and fusible member 44 may have mating engagement members 70 and 90 for non-slidably positioning fusible member 44 to support member 42, such as to inter-engage one another to reduce relative movement between support member 42 and fusible member 44.

In an alternative embodiment, the male and female nature of the engagement may be reversed. That is, support member engagement member 70 may be or include a groove for engaging fusible member engagement member 90, which may be or include a protrusion. In some cases, a plurality of corresponding engagement members may be provided. For example, other engagement members may be used such as a plurality of pins. Alternately, an adhesive or welding may be used.

As illustrated in FIG. 1*a*, securing member 56 is extendable through both support member 42 and fusible member 44 to secure support member 42 to a floor or ceiling 29. Securing member 56 may extend through a flange or central beam portion of floor or ceiling 29 or beam 32 (e.g., if the floor or ceiling is an I-beam). Floor or ceiling 29 or beam 32 has an appropriate alignable opening. As assembled, securing member 56 operates to compress the flange of the floor or ceiling assembly, support member 42 and fusible member 44 inwardly toward one another. Securing member 56 may have or be a bolt having two nuts. The bolt may have a first end portion and an opposing second end portion. Each end portion may have a nut mounted thereon. One nut may be fixedly attached to one of the first or second end portions, while the other nut is adjustably mounted to the other end portion.

Each nut 94 (or bolt head, as may be) engages an outer surface of at least one of the floor or ceiling 29 or support member 30, as may be, and one of support member 42 and fusible member 44. Additional layers of material may be added to the floor or ceiling 29, support member 42 and fusible member 44 combination. If additional layers are present, each nut may engage the outermost surface of each outermost layer. In the example provided in FIG. 1*a*, securing member 56 extends through, in series from top to bottom, floor or ceiling 29, or support member 30, support member 42 and fusible member 44. In this example, one nut 94 engages an upper surface 37 of an upper flange of the floor or ceiling 29 or support member 30, which may be an I-beam, for example. Alternatively, nut 94 could engage upper surface 38 of the lower flange of the illustrated I-beam that of the floor or ceiling 29, or really, of support member 30. In the illustrated example, the other nut 94 (or bolt head, as may be) engages the lower surface 78 of fusible member 44. When at least one of the two nuts 94 is or are tightened, the drawing-together of the two nuts 94 operates to compress the sandwich, be it of floor or ceiling 29, support member 30, support member first part 42 and fusible member 44 together. Typically, these three elements are compressed into abutting relationship with one another. In some cases, the three elements are compressed into an abutting relationship with one another such that the mating surfaces for the elements are in substantially flush relationship with one another in which the elements meet face-to-face over a comparatively large, substantially planar, area. The compressive force created by securing member 56 secures floor or ceiling 29 (or support member 30) and fusible member 44 to support member 42. Floor or ceiling 29 and fusible member 44 may be secured to second section 50 of support member 42. Support member 42 is connectable to firewall 20. Preferably, first section 48 of support member 42 is connectable to firewall 20. Therefore, floor or ceiling 29 (or support member 30, as may be) is securable to firewall 20 by support member 42. In the absence of heat, the combination of support member 42 and fusible member 44 couples floor or ceiling 29 (or support member 30, as may be) to firewall 20.

The following elements may be coupled together in the following order, from top to bottom: floor or ceiling 29 (or support member 30), support member 42 and fusible member 44. Support member 42 and fusible member 44 may be in abutting relationship with one another. In this case, support member engagement member 70 and fusible engagement member 90 are engagable with one another. However, the arrangement of elements from top to bottom may occur in other permutations of sequential order. Support member 42 and fusible member 44 may be separated from one another by floor or ceiling 29 or by support member 30, or a flange or other portion of member 30, as may be, or by first portion or leg 48. The compressive force generated by securing member 56 is relied upon to squeeze support member 42 and fusible member 44 together in the absence of the securing functionality of engagement members 70 and 90. In some cases, at least one of floor or ceiling 29, support member 42 and fusible member 44 may be offset from the horizontal such that the members are not necessarily coupled together in a linear, top-to-bottom relationship. In other embodiments, additional layers of material may be inserted into the sandwich so formed. There may be multiple fusible members, or only one.

As discussed, it may be beneficial for the floor or ceiling to be releasable from firewall 20 in the event of a fire or a heat-inducing explosion. Once the floor or ceiling is disengaged from the firewall 20, it is able to fall away from firewall 20 partially or predominantly in the downward direction. In some cases, as the floor or ceiling is heated by fire, it will deflect downwardly. This downward deflection may be most prevalent at the mid-span. Mid-span sagging may exert an axial force on break away connector system 40, inward and downward towards interior space 100. In this case, when release and separation from firewall 20 occur, the floor or ceiling may fall inward and downward, away from firewall 20. When a heat source (e.g., floor or ceiling 29, which is on fire) is free to fall away from firewall 20, the total heat experienced by the firewall may be reduced. This may increase the duration during which the firewall can remain intact.

FIG. 4*a* shows break-away connector system 40 as, or after, it has been subject to a heat-producing event, such as a fire or explosion. Since, in this embodiment, fusible member 44 has a lower melting point than support member 42, fusible member 44 is weakened while support member 42 remains intact. As non-limiting examples, fusible member 44 material may melt, shrivel, crack, shatter, contract, soften, buckle, burn or disintegrate when subjected to heat. FIG. 4*a* shows an example of fusible member 44 that has melted or shriveled under the influence of heat or fire, as may occur when fusible member 44 is made of a plastic. When the fusible member 44 weakens, a gap 'G' may form between any two of the floor or ceiling, support member 42 and fusible member 44. More importantly, even before a physical gap may be apparent, the compressive pre-load between the parts is lost as fusible member 44 relaxes (i.e., the friction between member 30 and member 42, that formerly prevented disengagement), is lost, allowing bolts 58 to move longitudinally the slots 66, 68. As a result, securing member 56 may disengage, or slide, into interior space 100, in a generally inward direction indicated by arrow 'A'.

In some embodiments, in operation in the face of sufficient heat or flame, the weakening of fusible member 44 may cause support member engagement member 70 to disengage from fusible member engagement member 90, as shown in FIG. 4*a*, for example. As an example, fusible member engagement member 90 may melt away from its mating contact with support member engagement 70 when fusible member 44 is subjected to heat. In the absence of this mating engagement, the outward force supplied by the mating engagement (which may be directed horizontally outward away from interior space 100) is removed. As soon as the tension in bolt 58 is relieved, e.g., by relaxation or melting or other degradation of fusible member 44, the friction due to that tensile pre-load between the toe of spanning member 30 and the upper surface of support member 42 is lost. When floor or ceiling 29 or support member 30 disengages from support member 42, it is free to fall away from the remainder of break-away connector system 40.

The release of floor or ceiling 29 or support member 30 from support member 42 may be caused by the disengagement of engagement members 70 and 90, the removal of the compressive force supplied by securing member 56, or a combination thereof or sufficient weakening of the fusible member to permit relative movement of the floor or ceiling and the support member. As shown in FIG. 4*b*, when fusible member 44 is weakened by heat, securing member 56 is free to slide through channel 66, or 68 of support member 42. FIG. 4*b* illustrates the same securing member at three different moments in time. Securing member 56 slides longitudinally away from wall 20, as indicated by the three example positions of securing member 56, 56' and 56" that are progressively further away from wall 20. When securing member 56 passes through the open end, the joist is disengaged. In some cases, as illustrated in FIG. 4*c*, fusible member 44 is free to fall in a generally downward direction under gravitational forces after securing member 56 has been slidably released from support member 42. Support member 42 remains fixedly secured to firewall 20. If the fusible member opening does not have an open end, as in FIG. 2*h*, then the securing member may break through the frangible or otherwise sacrificial portion of fusible member 44 that in normal conditions impedes the slidable release of securing member 56.

Securing member 56 may include structural elements other than a nut and bolt arrangement. For example, securing member 56 may include a screw having external threads configured to mate with engagable threading located on the floor or ceiling. Alternatively, securing member 56 may include an external clamp for engaging at least two of the outermost surfaces of the abutting floor or ceiling, support member 42 and fusible member 44 combination to compress these elements together.

In the example illustrated in FIGS. 3*a*-3*e*, first section 128 of support member 110 has at least one aperture 144 therethrough for receiving a corresponding attachment member 128 for securing support member 110 to firewall 20. As before, a support member 30, which may be a beam or joist for supporting a floor, or a rafter or other structural member for supporting a ceiling, may seat on support member 110, and be retained by a securing member 56, which may be a bolt 58. As illustrated, nut 94 at a first end of bolt 58 engages a lower flange upper surface 38 of, e.g., support member 30. If secured to the flange of support member 30, bolt 58 may be shorter than is secured through the entire floor, 29. In the FIG. 3*a*, for example, lower flange upper surface 72 may be the upper surface of a lower flange of an I-beam of a floor or ceiling. The second end portion of bolt 58 engages the lower surface 78 of fusible member 44. As illustrated, securing member 56 may compress floor or ceiling 29, or the flange of support member 30, support assembly 110 and fusible member 44 together to retain support member 30 to support assembly 110 in the assembled state.

Support assembly 110 is embedded in firewall 20, as opposed to being securable to the face of firewall 20 (as in the embodiment of FIG. 1*a*). First section 128 of support member 110 is embedded in firewall 20 and second section 130 extends from first section 128. As illustrated, when support member 110 is coupled to firewall 20, second section 130 remains exposed. Optional attachment member 142 may be a bolt, screw or the like located within firewall 20. First section 128 of support member 110 may be mounted, or placed, or located, within the area to be occupied by firewall 20 prior to firewall 20 being formed, that is, during construction. For example, if firewall 20 is made of poured concrete, first section 128 may be positioned in the forms prior to the pouring. Alternately, first section 128 may be placed on top of a concrete block of a lower course before the next concrete block of the course of blocks immediately above is placed thereon. Accordingly, attachment member 142 may secure first section 128 to a pre-existing portion of firewall 20 (i.e. a concrete block or a previously poured portion). Once the concrete is poured, first section 128 may be securely cured into firewall 20.

Second section 130, which stands outwardly exposed from firewall 20, has a slot or slots 66, 68 disposed therein. At least one securing member 56 may extend through each channel 66, 68 of support assembly 110, to couple the floor or ceiling, e.g., support member 30, to support assembly 110. Since first section 128 of support member 110 may be embedded in firewall 20, support member 110 may thereby be fixedly secured to firewall 20 and the floor or ceiling is nonetheless disengagable from support assembly 110, and therefore also from firewall 20. Although support assembly 110 as illustrated shows a U-shaped channel, support assembly 110 may, alternatively, also have the form or, for example, a plate, beam, or C-shaped channel with a portion suited for capture or embedment in firewall 20.

As before, when the two components, items 44 and 30, are moved towards each other, typically vertically on assembly, and into the assembled state, as in FIG. 3*a*, engagement members 70 and 90 inter-engage to reduce relative in the axial translation degree-of-freedom as between support channel 120 and fusible member 44.

A further embodiment or aspect of this description relates to a method of constructing a firewall connection system which may employ a break away connector system or assembly such as 40 or 110, or both as may be suitable. For brevity, the description of previously discussed figures is not repeated. Referring to FIGS. 1 and 3*a*, first section (48, 128) of support member (42, 120) is secured to a first structural member, such as firewall 20.

The second portion (50, 130) of the support member (42, 120) is secured to a second structural member. The second structural member may be floor or ceiling 29, or a support member 30 thereof. Second portion (50, 130) may be secured to the second structural member by passing at least one securing member (56) through second portion (50, 130) of support member (42, 120) and fusible member 44 and into the second structural member.

Support member (42, 120) may be secured to the first structural member prior to second section (50, 130) being secured to the second structural member, or vice versa. First section (48, 128) is secured to the first structural member before second section (50, 130) is secured to the second structural member. For example, when the first section (48, 128) is installed first, the exposed, or outwardly extending second section (50, 130), which stands outwardly proud and away from the wall, provides a surface upon which to support the floor or ceiling or beam or joist or rafter, against gravitational forces while the second section (50, 130) is secured thereto.

Support member (42, 120) has at least one open ended channel. Each channel 66 has an open end 67. Second section (50, 130) may be secured to the second structural member (such as the floor or ceiling support member 30 shown in FIGS. 1*a* and 3*a*) by passing at least one securing member (56) through at least one open ended channel 66, 68 of support member (42, 120) and through at least one opening 80 of fusible member 44. The method may also include positioning fusible member 44 in an abutting relationship with support member 42 or 120, as may be, respectively. In some cases, abutting surfaces of the support member (42, 120) and fusible member 44 are brought into substantially flush relationship with one another. The method may include inter-engaging the support member (42, 120) and the fusible member 44, as shown in FIGS. 1*a* and 3*a*. As discussed above, support member engagement member 70 and fusible member engagement member 90 are operable to inter-engage, and in some cases lockingly to secure, the support member (42, 120) and the fusible member 44 to one another. In some cases, securing first section (48, 128) of support member (42, 120) to the first structural member, e.g., wall 20 comprises fixedly securing first section (48, 128) so that support member (42, 120) is fixedly secured to the first structural member 20 when the second structural member 30 is disengagable from support member (42, 120). In some instances, securing member 56 may be secured to the second structural member 30 after the securing member 56 is passed into the second structural member 30. Securing member 56 may be secured to the second structural member such that securing member 56 remains attached to the second structural member when the fusible member 44 is weakened by heat.

In the further alternative embodiment of FIG. 5*a*, there is a support assembly 160 that may be understood in many respects to be substantially similar to support assembly 40 of FIG. 1*a*, and, for brevity of description, may be taken as being the same except as noted. Support assembly 160 is similar to support assembly 40 inasmuch as it has a first part 162, in other respects similar to first part 42 of assembly 40. As with support member 42, first part 162 has the shape of an angle iron having a first leg 168, corresponding generally to first leg 48; and a second leg 170 corresponding to second leg 50. As with second part 44, there is a second part 164, and as parts 42 and 44 are mutually engageable, parts 164 and 162 are also formed matingly and co-operatively to engage each other.

However, rather than having a discrete engagement member such as item 70 such as mounted to the underside of first leg 48, first leg 168 is provided with an engagement pattern, or field, or zone, or array 190, that array including a plurality of out-of-plane features or excursions, indicated generally as 192. The term "out-of-plane" in this context refers to what would otherwise be a substantially flat or substantially smooth surface, and that might typically be both planar and horizontal, although such a surface might not necessarily be planar but could, conceivably, be formed on a cylindrical or even spherical arc. The "out-of-plane" feature, or aspect refers to deviations in that surface from the profile of what would be an otherwise smooth surface, namely to asperities that deviate from the mean of what would otherwise be that smooth surface with some amplitude divergent in a direction normal to that mean surface. In the typical course, the asperities would be in the vertical or substantially vertical, or z-direction.

In the embodiment illustrated in FIGS. 5*a*, 5*b*, 6*a* and 6*b*, the zone or field of asperities has the form of a series of serrations, or corrugations, or ridges or valleys (or ridges and valleys), or grooves that extend cross-wise across undersurface 172 of second leg 170. In the embodiment illustrated, the grooves or ridges have the form of a regular flat-flanked, symmetrical, reversing saw-tooth 174. This need not be. The flanks could be curved, they could be scalloped, one side could be steeper than the other, and so on. Nonetheless, a regular, symmetric saw-tooth profile, as shown, may be convenient. To the extent that first part 162 is formed as an extruded or longitudinally rolled section of, for example, angle iron, the profile of undersurface 172 may be formed at the time of manufacture of a long piece of stock, either through an extrusion die or through rollers, or in a subsequent cold-working in a roll forming process. The long work-piece, formed in what is the y-direction in the illustrations, may then be cut to length according to yield brackets, such as support member 162. Although an out-of-plane zone or field is shown that has a predominant field direction, in this instance the asperities run in the y-direction in which, when engaged with a mating surface, there remains a degree-of-freedom in sliding, side-ways linear translation (i.e., in the y-direction), and obstruction to linear translation in the lengthwise direction of the leg (i.e., in the x-direction), the zone or field of asperities, be they ridges, or otherwise, need not necessarily have a dominant field direction, or may have more than one field direction. For example, the field may have a serrated or grooved appearance in profile not only when viewed looking cross-wise in the y-direction in side view, but also when looking length-wise in the x-direction in end view. Such a pattern may include diamond-shaped peaks and valleys, and may be produced by such processes as knurling.

Similarly, as assembly 40 includes part 44, assembly 160 includes second part 164. Second part 164, like part 44, functions as a thermal fuse. It is made of a thermally degrading material whose physical properties diminish on sufficiently long exposure to elevated temperature, or flames, such as to relax, and thereby to release or diminish the friction force that normally deters release of member 30 from assembly 160. As noted above, member 44 has an upper surface 76 that includes an indexing feature, or groove, 90 for engaging the mating indexing feature, or protrusion, 70. Similarly, part 164 has an upper surface 176 that has a mating area, or zone or array or field 180 with out-of-plane features that, as assembled, mate or otherwise engage with undersurface 172, the profiles of the two surfaces when mated then preventing sliding of part 164 relative to part 162 in the longitudinal or x-direction. The foregoing commentary made in respect of the possible alternative embodiments of undersurface 172 apply correspondingly to upper surface 176, as do the comments concerning the method of manufacture of the raw stock in extruded or rolled form that may then be cut appropriately to length.

Although it may be convenient, the mutually engaging profiles of parts 162 and 164 need not be mirror images of each other. That is, profiles may provide engagement without necessarily being the same or mirror images of each other. For example, a profile of serrated ridges may, nonetheless, engage a mating profile of diamond-shaped asperities of corresponding spacing, or a mating profile of either half as many or twice as many ridges. That is, where one set of ridges or grooves is an integer multiple of the other set, they may still engage. Although an angle bracket is shown, the out-of-plane zone or array or pattern, such as zone 190, may be applied to a channel or other section as may be used, such as second portion 130 of channel 120, for example.

While part 164 may, like part 44, be co-extensive with the respective mating portion of part 162, (or 42) e.g., by being rectangular and having the same, or substantially the same, length and width, it is not necessary that the first and second parts 162 and 164 have co-extensive footprints. For example, in the embodiment of FIGS. 6*a*, 6*b*, 7*a* and 7*b*, there is not merely one second part 164, but rather two, namely items 165, 166, each being held in engagement by a separate securing member 56. Each of items 165 and 166 mates with a different area, or region, or portion, of zone 180 of undersurface 172. Whereas all portions of the footprint of part 44 engage the underside of leg 50, it is not necessary that every portion or region of the undersurface 172 of leg 170 be engaged by a portion of a second part 164, nor is it necessary that every portion of each second part 164 be entirely engaged by undersurface 172. There may, for example, be portions, as at 184, that extend beyond the edge of undersurface 172, or that extend under slots 186, 188 of first part 162. Although there are two second parts 164 shown, there could be one, or three, or more, as may be suitable. Each second part may be held in place by one or more securing members 56.

The shape of the footprint of second part 164 need not be square or rectangular. In the embodiment of FIGS. 7*a* and 7*b*, for example, second part 164 has a round circular, or, more precisely, annular, footprint, and, other than the profiled engagement surface having the out-of-plane features of zone 190, second part 164 may have the general appearance of a round circular washer or spacer, with a central bore for admitting fastening member 56. The action of the securing members 56 compresses the second part 164 and all other members sandwiched between the ends of securing member 56, and when so compressed, the mating out-of-plane features of first and second parts 162 and 164 engage, and lock, securing them, and member 30, in position relative to each other. When having the form, substantially, of circular washers or spacers, second parts 164 may be made quickly and easily whether by moulding, or by cutting and forming from a feedstock rod, and may be installed or replaced correspondingly quickly and easily. To the extent that the influence of securing member 56 may not place the entirety of second part 164 under uniform compression, less material, such as found in second parts 165, 166 may permit a comparative savings of raw material overall in forming the fusible members as compared to second part 164.

To the extent that the thermal fuse function is retained, securing members 56 and second parts 164 in their circular washer-like form, or in a form that corresponds to a portion of the total area of the underside of the support bracket, may be employed in respect of brackets such as bracket 48 or in respect of channel 120, or the equivalents thereof, and may be used in such quantity, (be it one, two, three, four, or more) as may be appropriate in the circumstances.

What has been described above has been intended illustrative and non-limiting and it will be understood by persons skilled in the art that other variances and modifications may be made without departing from the scope of the disclosure as defined in the claims appended hereto. Various embodiments of the invention have been described in detail. Since changes in and or additions to the above-described best mode may be made without departing from the nature, spirit or scope of the invention, the invention is not to be limited to those details but only by the appended claims.

What is claimed is:

1. A self-releasing structural support assembly, said assembly comprising:

a first member and a second member;

said first member being made of a fireproof material;

said first member having a first portion and a second portion;

said first portion of said first member defining an anchor member by which said first member can be permanently secured to a structural reference datum member, and through which, when installed, a shear load can be passed into the structural reference datum member;

said second portion of said first member defining a reaction seat upon which to carry a foot of a spanning member and through which to receive a shear load from the spanning member;

said second portion of said first member having a spanning member securement accommodation;

said second portion of said first member having a first zone of asperities;

said second member being one of (a) fire degradable; and (b) temperature degradable said second member having a spanning member securement retention fitting that is co-operable with said spanning member securement accommodation;

said second member having a second zone of asperities;

on installation, said second zone of asperities of said second member being in mating cooperation with said first zone of asperities of said first member, and in operation, when so mated, said second member being secured in a position preventing disengagement of the spanning member; and in operation, when said second member is degraded by either one of (a) fire and (b) heat, the spanning member is insecure from disengagement from the first member.

2. The self-releasing structural support assembly of claim 1 wherein there is more than one said second member.

3. The self-releasing structural support assembly of claim 2 wherein said first member has a footprint, and at least one said second member has a footprint that is not co-extensive with said footprint of said first member.

4. The self-releasing structural support assembly of claim 1 wherein there is a degree of freedom defining a direction of permissible disengagement of the spanning member from said first member when, in operation, said spanning member is insecure, and at least one of said first and second zones of asperities includes ridge members extending cross-wise relative to said degree of freedom.

5. The self-releasing structural support assembly of claim 1 wherein at least one of said first and second zones of asperities includes a plurality of serrations.

6. The self-releasing structural support assembly of claim 5 wherein there is a plurality of said second members made of heat degradable material, each of said second members has a serrated face for engagement with a matching serrated face of said first member, each of said second members is annular in cross-section; and each said spanning member securement retention fitting is a threaded fastener that, on installation, passes through the annular cross-section of the associated second member.

7. The self-releasing structural support assembly of claim 1 wherein, when installed, said seat is upwardly facing and said second member is located below said seat.

8. The self-releasing structural support assembly of claim 1 wherein, as installed, the condition of said second member is ascertainable, and said second member is replaceable, while the foot of the spanning member remains supported by the seat.

9. The self-releasing structural support assembly of claim 1 wherein said structural support assembly is mountable to a substantially planar wall, and, when mounted to such substantially planar wall, said spanning member securement accommodation of said second portion of said first member has a degree of freedom of linear translation substantially normal to said wall, and said seat has a range of accommodation positions for the beam end along said degree of freedom.

10. The self-releasing structural support assembly of claim 9 wherein said range of accommodation positions is at least 2 inches long.

11. The self-releasing structural support assembly of claim 1 wherein said first member is one of:

(a) an angled member having a first leg for mounting to a wall, and a second, cantilevered leg that stands outwardly of the wall when the first leg is mounted thereto; and (b) a channel member having two legs and a back extending therebetween, such that when said channel member is embedded in a wall said back thereof is substantially horizontal and defines said seat.

12. The self-releasing structural support assembly of claim 1 in combination with embedment anchor hardware, said anchor member having fittings defined therein cooperable with said hardware.

13. The self-releasing structural support assembly of claim 1 in combination with beam engagement fittings, said beam engagement fittings being threaded fasteners, said accommodations defining slots, wherein, in use, said second member, said second portion of said first member, and the foot of the spanning member are stacked together in a sandwich, and said threaded fasteners secure said sandwich, said sandwich being in compression and said threaded fasteners being in tension.

14. The self-releasing structural support member of claim 13 wherein said first member is one of:

(a) an angled member having a first leg for mounting to a wall, and a second, cantilevered leg that stands outwardly of the wall when the first leg is mounted thereto; and (b) a channel member having two legs and a back extending therebetween, such that when said channel member is embedded in a wall said back thereof is substantially horizontal and defines said seat;

said first member is mountable to a substantially planar wall, and when mounted to such substantially planar wall, said spanning member securement accommodation of said second portion of said first member includes at least a first slot, said first slot having a degree of freedom of linear translation substantially normal to said wall, and said seat has a range of accommodation positions for the foot of the spanning member along said degree of freedom;

when installed, said seat is upwardly facing and said second member is located below said seat;

as installed, the condition of said second member is ascertainable; and said second member is replaceable while the foot of the spanning member remains supported by the seat.

15. A self-releasing beam end support assembly, said assembly comprising:

a support fitting and at least a first consumable member and a second consumable member;

said support fitting defining a seat upon which to support a beam end, and defining an anchor by which to attach said support fitting to a wall structure, and, once installed, by which to transfer ordinary loads from the beam to the wall structure;

said consumable members and said support fitting having co-operating beam fastener accommodations;

said support fitting having at least one engagement fitting interface;

said first and second consumable members having respective first and second engagement fitting interfaces that, on installation, mate with said at least one engagement fitting interface of said support fitting to constrain location of said first and second consumable members relative to said support fitting;

said first and second consumable members each being one of (a) thermally degradable; and (b) fire degradable; and in operation, under a first, non-degraded condition of each said consumable member, said support fitting and that consumable member are co-operable with at least one beam fastener to discourage dislodgement of the beam end from said seat; and in operation, under a second, degraded, condition of each said consumable member, (a) said support fitting remains operable to carry a static load, and (b) said support fitting and each said consumable member are co-operable to permit release of the beam end from said seat under abnormal loading.

16. The self-releasing beam end support assembly of claim 15 wherein said first and second consumable members are of the same shape and size, and have the form of cylindrical members of annular cross-section.

17. The self-releasing beam end support assembly of claim 15 wherein:

said support fitting engagement fitting interface includes at least one zone of asperities having a first footprint;

said first consumable member has a first consumable member asperity footprint that, on installation, mates with at least a portion of a corresponding region of a zone of asperities of said engagement fitting interface of said support fitting;

said second consumable member has a second consumable member asperity footprint that, on installation, mates with at least a portion of a corresponding region of a zone of asperities of said engagement fitting interface of said support fitting; and said footprint of said support fitting engagement fitting interface is non-co-extensive with either respective footprint of said first and second consumable member asperity footprints.

18. The self-releasing beam end support assembly of claim 17 wherein said footprint of said support fitting engagement fitting interface includes regions that extend beyond said footprints of said consumable members.

19. The self-releasing beam end support assembly of claim 17 wherein said footprints of said consumable members include regions that extend beyond said footprint of said support fitting engagement fitting interface.

* * * * *